US007158163B2

(12) United States Patent
Komiya et al.

(10) Patent No.: US 7,158,163 B2
(45) Date of Patent: Jan. 2, 2007

(54) LIGHT BEAM SCANNING APPARATUS CAPABLE OF SHORTENING THE STANDBY TIME AND IMAGE FORMING APPARATUS CAPABLE OF SHORTENING THE STANDBY TIME

(75) Inventors: Kenichi Komiya, Kawasaki (JP); Koji Tanimoto, Shizuoka-ken (JP); Daisuke Ishikawa, Shizuoka-ken (JP); Yuji Inagawa, Numazu (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 300 days.

(21) Appl. No.: 10/805,531

(22) Filed: Mar. 22, 2004

(65) Prior Publication Data

US 2005/0206718 A1 Sep. 22, 2005

(51) Int. Cl.
*B41J 2/435* (2006.01)

(52) U.S. Cl. ..... 347/224; 347/250; 347/235; 347/260; 347/129; 250/205

(58) Field of Classification Search ..... 347/224, 347/250, 235, 260, 129, 139; 250/205; 358/502
See application file for complete search history.

(56) References Cited

U.S. PATENT DOCUMENTS 5,374,947 A * 12/1994 Takahashi et al. ..... 347/224
5,883,659 A * 3/1999 Serizawa et al. ..... 347/260
6,483,529 B1 * 11/2002 Ito et al. ..... 347/235
6,549,265 B1 4/2003 Sakakibara et al.
6,795,099 B1 * 9/2004 Koga et al. ..... 347/129

FOREIGN PATENT DOCUMENTS

JP 2001-88344 A 4/2001

OTHER PUBLICATIONS

U.S. Appl. No. 10/805,306, filed Mar. 22, 2004, Komiya et al.

* cited by examiner

*Primary Examiner*—Hai Pham
*Assistant Examiner*—Carlos A Martinez
(74) *Attorney, Agent, or Firm*—Foley & Lardner LLP

(57) ABSTRACT

A light beam scanning apparatus according to an embodiment of this invention includes a reflection unit for reflecting a light beam, a rotation unit for rotating the reflection unit, a rotation control unit for controlling rotation of the rotation unit, a rotational speed detection unit for detecting a rotational speed of the rotation unit, a light amount control unit for, before the rotational speed detection unit detects that the rotational speed has reached a predetermined rotational speed, controlling light emission of the light beam and controlling the light amount of the light beam to a predetermined value, and a light emission control unit for, after the rotational speed detection unit detects that the rotational speed has reached the predetermined rotational speed, controlling a light emission timing of the light beam.

11 Claims, 17 Drawing Sheets

LIGHT BEAM SCANNING APPARATUS CAPABLE OF SHORTENING THE STANDBY TIME AND IMAGE FORMING APPARATUS CAPABLE OF SHORTENING THE STANDBY TIME

BACKGROUND OF THE INVENTION

1. Field of the Invention

The present invention relates to a light beam scanning apparatus which scans, on a photosensitive drum, a light beam based on image data. The present invention also relates to an image forming apparatus to which the light beam scanning apparatus is applied.

2. Description of the Related Art

A laser driving circuit in an image forming apparatus supplies a predetermined DC current (bias current) to a laser and, in addition to this current supply, supplies even a switch current that is switched in accordance with image data, thereby causing the laser to emit a light beam. As a characteristic of a laser, its light emission amount changes in proportion to a supplied current. Hence, when the current to be supplied to the laser is controlled, the laser emission amount for image formation can be controlled.

As control to keep a predetermined laser power, APC (Auto Power Control) is known. In APC, the light emission amount of a laser is detected. The light emission amount detection level is compared with a reference value as the target value of laser power. Accordingly, the current amount to be supplied to the laser is controlled to maintain a predetermined laser power.

A light beam emitted from a laser is reflected by a polygon mirror rotated at a predetermined rotational speed by a polygon motor and scans the surface of a photosensitive drum. That is, an electrostatic latent image is formed on the photosensitive drum by scanning the light beam whose light emission timing is controlled in correspondence with the image data.

Conventional APC is started after the polygon motor reaches a predetermined rotational speed, and the rotational speed stabilizes. A predetermined time is necessary until the polygon motor reaches a predetermined rotational speed, and the rotational speed stabilizes. For example, when the polygon motor that is set in a stopped state in a power saving mode or the like is reactivated, some standby time is required until the start of APC. As a result, the standby time from reactivation to image formation is long.

BRIEF SUMMARY OF THE INVENTION

It is an object of the present invention to provide a light beam scanning apparatus capable of contributing to shortening of the standby time from reactivation to image formation. It is another object of the present invention to provide an image forming apparatus capable of shortening the standby time from reactivation to image formation.

According to an aspect of the present invention, there is provided a light beam scanning apparatus comprising light emission means for emitting a light beam, light amount detection means for detecting a light amount of the light beam emitted by the light emission means, reflection means for reflecting the light beam to scan the light beam emitted by the light emission means, rotation means for rotating the reflection means to scan the light beam emitted by the light emission means, rotation control means for controlling rotation of the rotation means, rotational speed detection means for detecting that a rotational speed of the rotation means has reached a predetermined rotational speed, light amount control means for, before the rotational speed detection means detects that the rotational speed has reached the predetermined rotational speed, controlling light emission of the light beam by the light emission means and controlling the light amount of the light beam emitted by the light emission means to a predetermined value on the basis of a light amount detection result detected by the light amount detection means in correspondence with the light emission, and light emission control means for, after the rotational speed detection means detects that the rotational speed has reached the predetermined rotational speed, controlling a light emission timing of the light beam by the light emission means on the basis of image data.

According to another aspect of the present invention, there is provided an image forming apparatus comprising light emission means for emitting a light beam, light amount detection means for detecting a light amount of the light beam emitted by the light emission means, reflection means for reflecting the light beam to scan the light beam emitted by the light emission means, rotation means for rotating the reflection means to scan the light beam emitted by the light emission means, rotation control means for controlling rotation of the rotation means, rotational speed detection means for detecting that a rotational speed of the rotation means has reached a predetermined rotational speed, light amount control means for, before the rotational speed detection means detects that the rotational speed has reached the predetermined rotational speed, controlling light emission of the light beam by the light emission means and controlling the light amount of the light beam emitted by the light emission means to a predetermined value on the basis of a light amount detection result detected by the light amount detection means in correspondence with the light emission, light emission control means for, after the rotational speed detection means detects that the rotational speed has reached the predetermined rotational speed, controlling a light emission timing of the light beam by the light emission means on the basis of image data, and image forming means for forming an image on the basis of the light beam whose light emission timing is controlled by the light emission control means and which is reflected by the reflection means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The first embodiment of the present invention will be described with reference to FIGS. 1 to 8. In the first embodiment, a multi-beam type light beam scanning apparatus which forms an image by a plurality of light beams and an image forming apparatus to which the multi-beam type light beam scanning apparatus is applied will be described.

Figure 1:
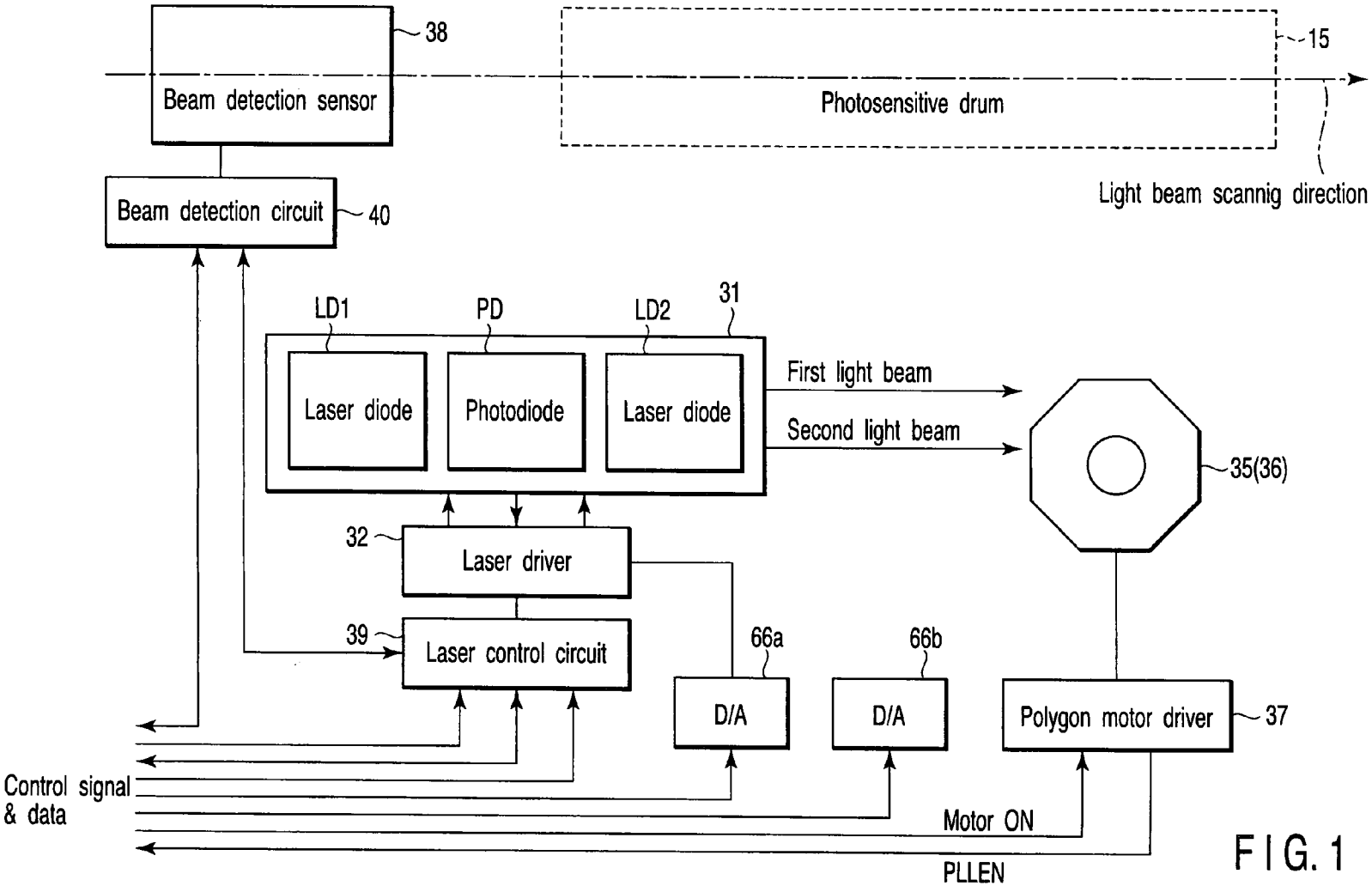
FIG. 1 is a view showing the schematic arrangement of a multi-beam type light beam scanning apparatus according to an embodiment of the present invention and the positional relationship between the light beam scanning apparatus and a photosensitive drum.
Figure 2:
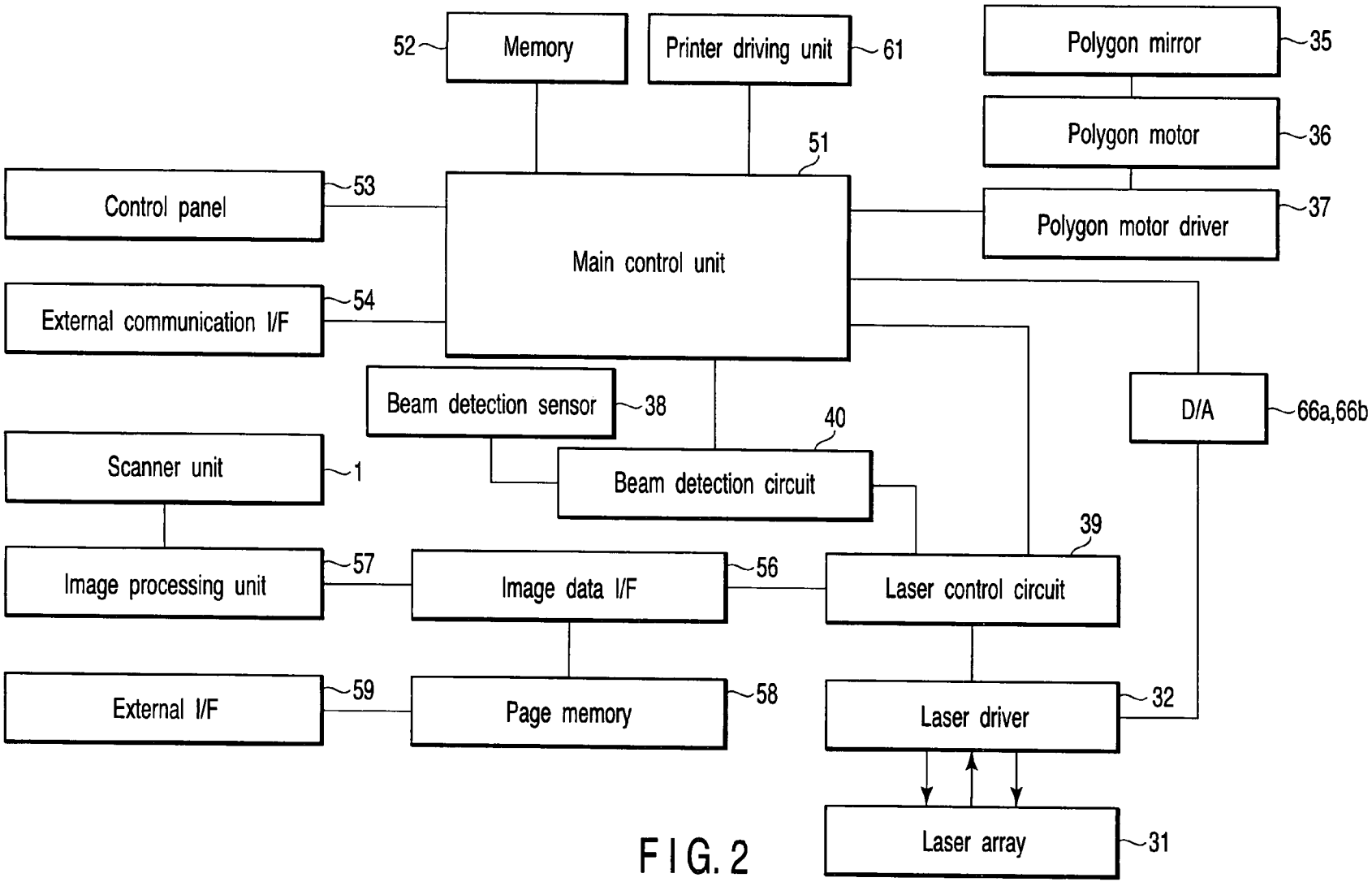
FIG. 2 is a control block diagram showing the schematic arrangement of an image forming apparatus to which the multi-beam type light beam scanning apparatus according to the embodiment of the present invention is applied.
Figure 3:
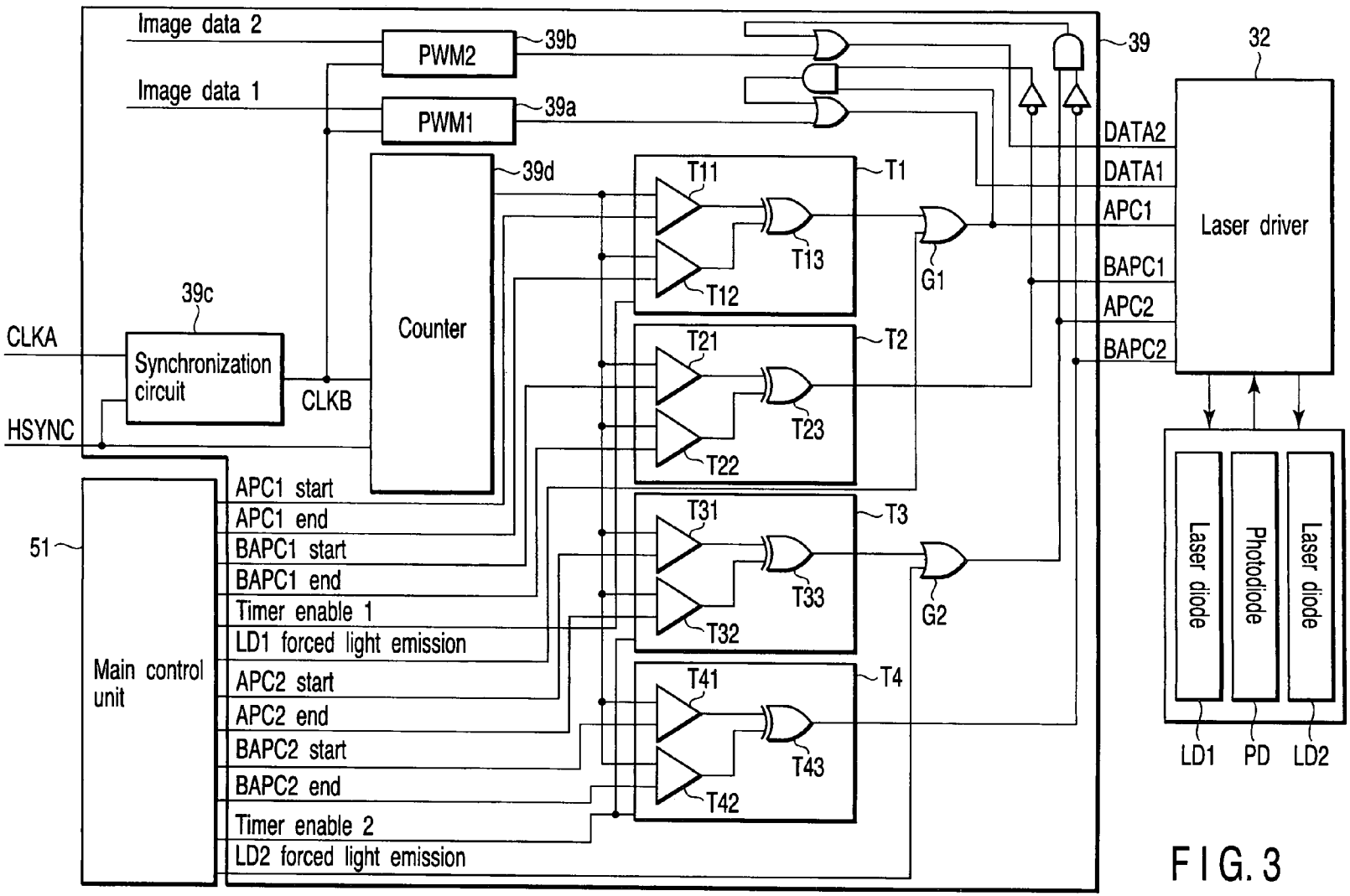
FIG. 3 is a block diagram showing the detailed arrangement of a laser control circuit applied to the multi-beam type light beam scanning apparatus.

FIG. 1 is a view showing the schematic arrangement of a multi-beam type light beam scanning apparatus according to an embodiment of the present invention and the positional relationship between the light beam scanning apparatus and a photosensitive drum. FIG. 2 is a control block diagram showing the schematic arrangement of an image forming apparatus to which the multi-beam type light beam scanning apparatus according to the embodiment of the present invention is applied. FIG. 3 is a block diagram showing the detailed arrangement of a laser control circuit applied to the multi-beam type light beam scanning apparatus.

As shown in FIG. 1, the light beam scanning apparatus comprises a polygon mirror 35 serving as a reflection means, a polygon motor 36 serving as a rotation means, a polygon motor driver 37 serving as a rotation control means and rotational speed detection means, a beam detection sensor 38 serving as a light amount detection means, a beam detection circuit 40 serving as a light amount detection means, a laser array 31 serving as a light emission means, a laser driver 32 serving as a light amount control means and light amount control means, a laser control circuit 39 serving as a light amount control means and light amount control means, D/A converters 66*a* and 66*b*, and optical elements such as fθ lens.

The laser array 31 comprises laser diodes LD1 and LD2 serving as a light emission means (light source) and a photodiode PD. The photodiode PD detects the laser light amount. The light emission powers (light amounts) and light emission timings of the laser diodes LD1 and LD2 are controlled by the laser driver 32. The laser driver 32 incorporates an auto power control (APC) circuit and causes the laser diodes LD1 and LD2 to emit light at a light emission power level set from a main control unit (CPU) 51 shown in FIG. 2. The laser driver 32 controls the light emission timings of the laser diodes LD1 and LD2 on the basis of image data. In executing auto power control, the light amounts of the laser diodes LD1 and LD2 are controlled on the basis of the light amount detected by the photodiode PD.

Light beams emitted from the laser diodes LD1 and LD2 pass through a collimator lens and a half mirror and then become incident on the polygon mirror 35. The light beams reflected by the polygon mirror 35 pass through the light-receiving surface of the beam detection sensor 38, scan the surface of a photosensitive drum 15, and form an electrostatic latent image on the photosensitive drum 15.

The polygon motor driver 37 starts rotating the polygon motor 36 in response to a motor ON signal from the main control unit 51 serving as a rotation control means and rotates the polygon motor 36 at a predetermined rotational speed. Upon detecting that the polygon motor 36 has reached the predetermined rotational speed, the polygon motor driver 37 outputs a PLLEN signal to the main control unit 51 to notify it that the polygon motor 36 is rotating at the predetermined rotational speed.

The beam detection sensor 38 detects the passage position and passage timing of a light beam and its power on the surface (a position equivalent to the surface of the photosensitive drum 14) of the photosensitive drum 14. The beam detection sensor 38 is disposed near the end portion of the photosensitive drum 15 while aligning the light-receiving surface with the surface of the photosensitive drum 15. The sensor signal from the beam detection sensor 38 is input to the beam detection circuit 40. The beam detection circuit 40 detects the passage position and passage timing of the light beam and its power on the surface (a position equivalent to the surface of the photosensitive drum 14) of the photosensitive drum 14 on the basis of the sensor signal from the beam detection sensor 38. On the basis of the detection result from the beam detection circuit 40, the light emission powers and light emission timings of the laser diodes LD1 and LD2 are controlled. The beam detection circuit 40 also outputs a horizontal sync signal (HSYNC) on the basis of detection of the passage timing of the light beam.

The laser control circuit 39 controls the light emission timings of the laser diodes LD1 and LD2. The D/A converters 66*a* and 66*b* output reference voltages such that the laser driver 32 causes the laser diodes LD1 and LD2 to emit light in predetermined light amounts. The main control unit 51 instructs the reference voltages to the D/A converters 66*a* and 66*b* by digital values. The D/A converters 66*a* and 66*b* convert the reference voltages instructed by the digital values into analog values.

As shown in FIG. 2, the main control unit 51 executes overall control. The laser driver 32, polygon mirror motor driver 37, beam detection circuit 40, and printer driving unit 61 are connected to the main control unit 51 through a memory 52, control panel 53, external communication interface (I/F) 54, and D/A converters 66*a* and 66*b*.

The flow of image data in forming an image will briefly be described below.

The control panel 53 is a man-machine interface which activates the copy operation or sets the number of copies. The control panel 53 receives, e.g., a copy operation instruction. In correspondence with the copy operation instruction, the image of an original is read by a scanner unit 1 and sent to an image processing unit 57. The image processing unit 57 executes predetermined processing for the image signal from the scanner unit 1. The image data from the image processing unit 57 is sent to the laser control circuit 39 through an image data I/F 56.

This digital copying machine is designed to be able to form and output even image data externally input through an external I/F 59 connected to a page memory 58 in addition to the copy operation.

When the digital copying machine is externally controlled through, e.g., a network, the external communication I/F 54 functions as the control panel 53.

The polygon motor driver 37 is a driver which drives the polygon motor 36 to rotate the polygon mirror 35 which scans the light beam. The main control unit 51 executes rotation start control and rotation stop control for the polygon motor driver 37 (details will be described later).

The memory 52 stores information necessary for control. For example, a circuit characteristic (the offset value of an amplifier) necessary for detecting the passage position of a light beam and print area information corresponding to a light beam are stored.

APC will be described next. The main control unit 51 supplies, to the laser control circuit 39, an APC 1 start signal, APC 1 end signal, BAPC 1 start signal, BAPC 1 end signal, timer enable 1 signal, LD 1 forced light emission signal, APC 2 start signal, APC 2 end signal, BAPC 2 start signal, BAPC 2 end signal, timer enable 2 signal, and LD 2 forced light emission signal. On the basis of the supplied signals, the laser control circuit 39 controls forced light beam emission at a timing outside the image area. On the basis of a light amount detection result detected in correspondence with the forced light emission, the main control unit 51 outputs a light amount control signal that controls the amount of the light beam to a predetermined value. The laser control circuit 39 controls the light amounts of the laser diodes LD1 and LD2 on the basis of the light amount control signal output from the main control unit.

As shown in FIG. 3, the laser control circuit 39 comprises PWMs (Pulse Width Modulators) 39*a* and 39*b*, synchronization circuit 39*c*, counter 39*d*, timers T1, T2, T3, and T4, and OR gates G1 and G2.

A reference clock (CLKA) and horizontal sync signal (HSYNC) are input to the synchronization circuit 39*c*. On the basis of the reference clock (CLKA), the synchronization circuit 39*c* outputs an image clock (CLKB) synchronized with the horizontal sync signal (HSYNC). The image data and image clock (CLKB) are input to the PWMs 39*a* and 39*b*. The PWM 39*a* outputs image data 1 (e.g., odd-line data) synchronized with the image clock (CLKB) as a laser modulation signal. On the other hand, the PWM 39*b* outputs image data 2 (e.g., even-line data) synchronized with the image clock (CLKB) as a laser modulation signal. The laser driver 32 controls the light emission timing of the laser oscillator 31 on the basis of the laser modulation signals. When the image data 1 and 2 are transferred in this way, two lines of latent images are formed on the photosensitive drum 15 in correspondence with input of the horizontal sync signal. The printer driving unit 61 shown in FIG. 2 forms a print image on a predetermined paper sheet on the basis of the electrostatic latent images on the photosensitive drum 15.

The image clock (CLKB) synchronized with the horizontal sync signal (HSYNC) and the horizontal sync signal (HSYNC) are input to the counter 39*d*. The counter 39*d* counts the image clock (CLKB) and also clears the count value of the image clock (CLKB) in accordance with the horizontal sync signal (HSYNC). The output (count value) from the counter 39*d* is input to the timers T1, T2, T3, and T4.

The timer T1 functions for APC to forcibly cause the laser diode LD1 to emit light in a non-image region and control the power of the light beam. In other words, the timer T1 has a function of preventing the photosensitive drum 15 from being irradiated and developed with the light beam emitted from the laser diode LD1 by forced light emission for APC execution.

The timer T1 incorporates comparators T11 and T12 and an EXOR circuit T13. The output from the comparator T11 is connected to one terminal of the EXOR circuit T13, and the output from the comparator T12 is connected to the other terminal of the EXOR circuit T13. The output from the EXOR circuit T13 is the output from the timer T1. The timer T1 also has an enable terminal that receives a timer enable signal output from the main control unit 51. When a timer enable signal of low level is input through the enable terminal, the output from the timer T1 is fixed to low level. That is, to use the timer T1, a timer enable signal of high level is input to the enable terminal.

The output (count value) from the counter 39*d* is input to one input terminal of the comparator T11. A comparative reference value (APC 1 start signal) from the main control unit 51 is input to the other input terminal of the comparator T11. The comparator T11 compares the count value from the counter 39*d* with the comparative reference value set by the main control unit 51. When the count value is smaller than the comparative reference value, the comparator T11 outputs a low-level signal. Conversely, when the count value is larger than the comparative reference value, the comparator T11 outputs a high-level signal. The output (count value) from the counter 39*d* is input to one input terminal of the comparator T12. A comparative reference value (APC 1 end signal) from the main control unit 51 is input to the other input terminal of the comparator T12. The comparator T12 compares the count value from the counter 39*d* with the comparative reference value set by the main control unit 51. When the count value is smaller than the comparative reference value, the comparator T12 outputs a low-level signal. Conversely, when the count value is larger than the comparative reference value, the comparator T12 outputs a high-level signal.

The outputs from the comparators T11 and T12 are connected to the EXOR circuit T13. For example, m is set as the comparative reference value for the comparator T11, and n (m<n) is set as the comparative reference value for the comparator T11. In this case, the timer T1 outputs a timer 1 signal (APC signal) of high level only in the section from m to n. The timer 1 signal (APC 1 signal) output from the timer T1 is input to the laser driver 32 through the OR gate G1. When the APC 1 signal is at high level, the laser driver 32 forcibly causes the laser to emit light.

The timer T2 incorporates comparators T21 and T22 and an EXOR circuit T23. The output from the comparator T21 is connected to one terminal of the EXOR circuit T23, and the output from the comparator T22 is connected to the other terminal of the EXOR circuit T23. The output from the EXOR circuit T23 is the output from the timer T2. The timer T2 also has an enable terminal that receives a timer enable signal output from the main control unit 51. When a timer enable signal of low level is input through the enable terminal, the output from the timer T2 is fixed to low level. That is, to use the timer T2, a timer enable signal of high level is input to the enable terminal.

The output (count value) from the counter 39*d* is input to one input terminal of the comparator T21. A comparative reference value (BAPC 1 start signal) from the main control unit 51 is input to the other input terminal of the comparator T21. The comparator T21 compares the count value from the counter 39*d* with the comparative reference value set by the main control unit 51. When the count value is smaller than the comparative reference value, the comparator T21 outputs a low-level signal. Conversely, when the count value is larger than the comparative reference value, the comparator T21 outputs a high-level signal. The output (count value) from the counter 39*d* is input to one input terminal of the comparator T22. A comparative reference value (BAPC 1 end signal) from the main control unit 51 is input to the other input terminal of the comparator T22. The comparator T22 compares the count value from the counter 39*d* with the comparative reference value set by the main control unit 51. When the count value is smaller than the comparative reference value, the comparator T22 outputs a low-level signal. Conversely, when the count value is larger than the comparative reference value, the comparator T22 outputs a high-level signal.

The outputs from the comparators T21 and T22 are connected to the EXOR circuit T23. For example, m is set as the comparative reference value for the comparator T21, and n (m<n) is set as the comparative reference value for the comparator T21. In this case, the timer T2 outputs a timer 2 signal (BAPC 1 signal) of high level only in the section from m to n. The timer 2 signal (BAPC 1 signal) output from the timer T2 is input to the laser driver 32. When the BAPC 1 signal is at high level, the laser driver 32 forcibly causes the laser to emit light at low level.

The timer T3 functions for APC to forcibly cause the laser diode LD2 to emit light in a non-image region and control the power of the light beam. In other words, the timer T3 has a function of preventing the photosensitive drum 15 from being irradiated and developed with the light beam emitted from the laser diode LD2 by forced light emission for APC execution. The basic arrangement of the timer T3 is the same as that of the timer T1, and a detailed description thereof will be omitted. When n (m<n) is set as the comparative reference value for a comparator T31, the timer T3 outputs a timer 3 signal (APC 2 signal) of high level only in the section from m to n. The timer 3 signal (APC 2 signal) output from the timer T3 is input to the laser driver 32. When the APC 2 signal is at high level, the laser driver 32 forcibly causes the laser to emit light.

The basic arrangement of the timer T4 is the same as that of the timer T2, and a detailed description thereof will be omitted. When n (m<n) is set as the comparative reference value for a comparator T41, the timer T4 outputs a timer 4 signal (BAPC 2 signal) of high level only in the section from m to n. The timer 4 signal (BAPC 2 signal) output from the timer T4 is input to the laser driver 32. When the BAPC 2 signal is at high level, the laser driver 32 forcibly causes the laser to emit light at low level.

With the above arrangement, the light beam scanning apparatus can freely generate the APC 1 signal, BAPC 1 signal, APC 2 signal, and BAPC 2 signal between a horizontal sync signal (HSYNC) and the next horizontal sync signal (HSYNC) by counting the image clock (CLKB) synchronized with the horizontal sync signal (HSYNC) and setting predetermined comparative reference values (timings that are prepared in advance) for the timers T1, T2, T3, and T4. As described above, since the APC 1 signal and APC 2 signal can freely be generated, the light emission timing of the laser oscillator 31 can freely be controlled.

Figure 4:
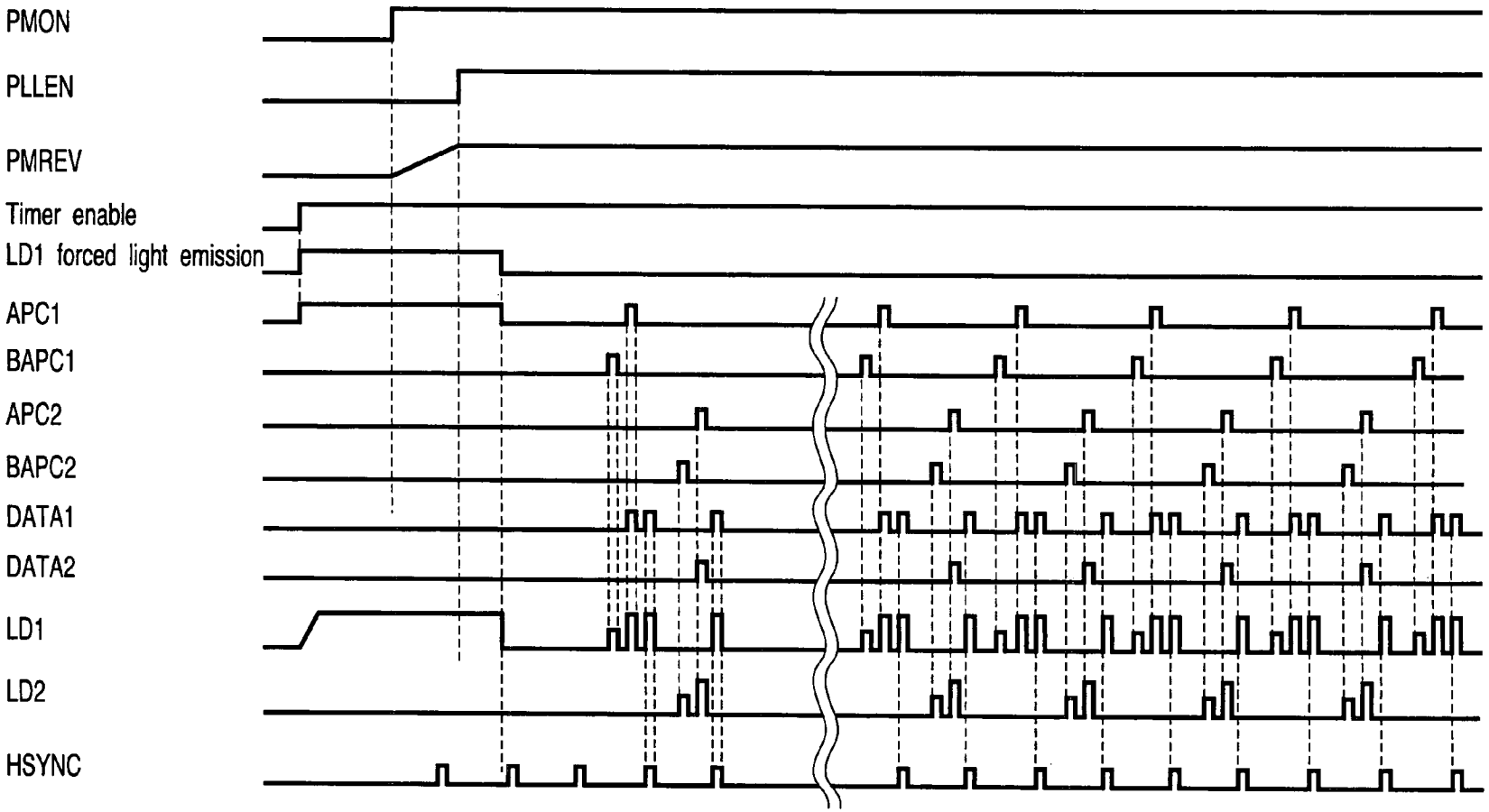
FIG. 4 is a timing chart for explaining the APC execution timing by the multi-beam scanning apparatus (the image forming apparatus to which the multi-beam scanning apparatus is applied) described in FIGS. 1 and 3.
Figure 5:
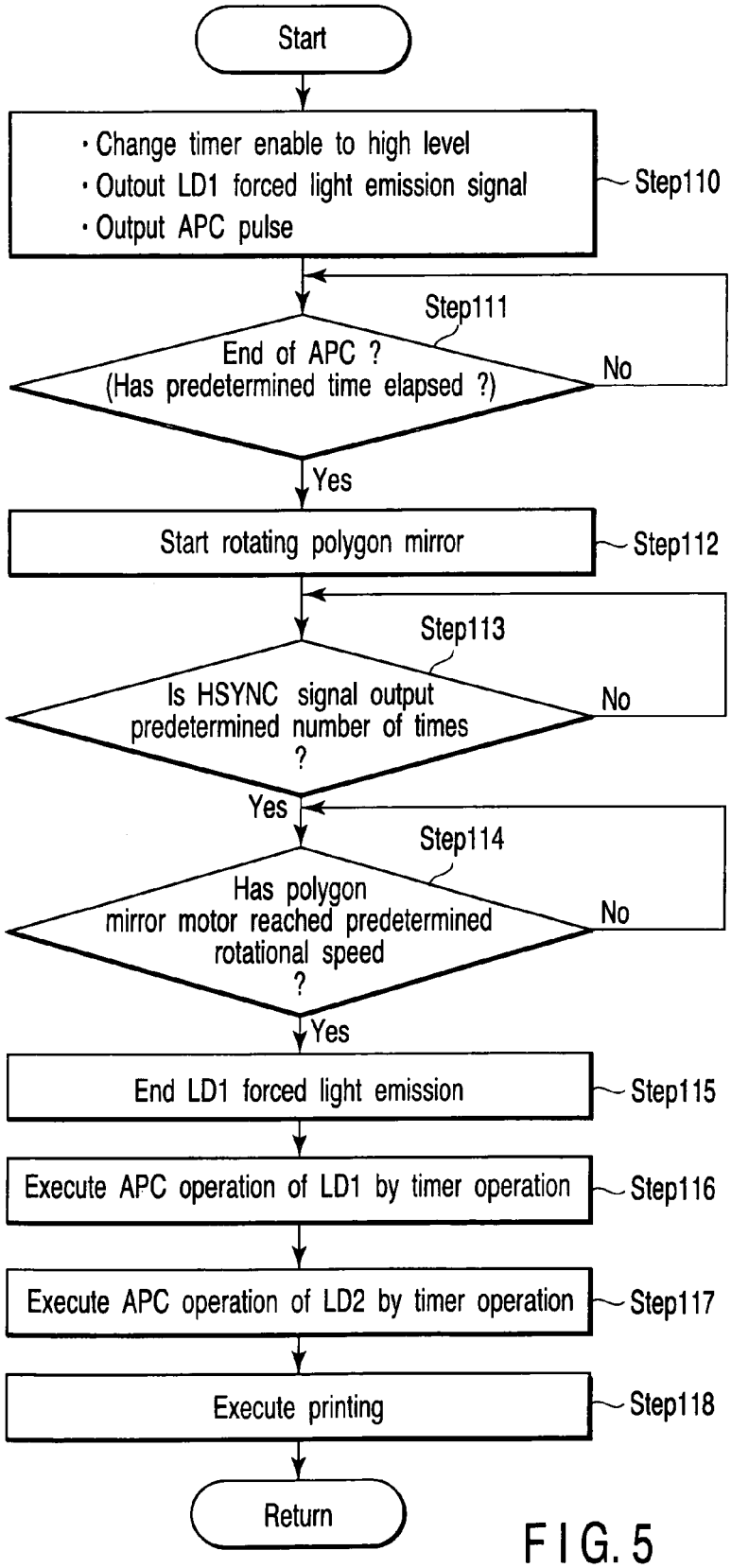
FIG. 5 is a flowchart for explaining the APC execution timing corresponding to the timing chart shown in FIG. 4.

FIG. 4 is a timing chart for explaining the APC execution timing by the multi-beam scanning apparatus (the image forming apparatus described in FIG. 2) described in FIGS. 1 and 3. FIG. 5 is a flowchart for explaining the APC execution timing corresponding to the timing chart shown in FIG. 4. In this APC execution timing, APC 1 is executed in which forced light emission is started before the rotational speed of the polygon motor 36 reaches a predetermined rotational speed, and in correspondence with this forced light emission, the amount of the light beam is controlled to a predetermined value. Details will be described below.

The main control unit 51 validates the operations of the timers T1, T2, T3, and T4 which control the APC timing. That is, the main control unit 51 changes the timer enable signal from Low level to High level (step 110). The timer enable signal is always maintained in the High level state while the operations of the timers T1, T2, T3, and T4 are validated.

Simultaneously, the main control unit 51 outputs an LD1 forced light emission signal to the laser driver 32 (step 110) to forcibly cause the laser diode LD1 to emit light. That is, the main control unit 51 changes the LD1 forced light emission signal from Low level to High level. The LD1 forced light emission signal is input to the laser driver 32 through the OR gate G1 as the APC 1 signal. That is, when the LD1 forced light emission signal changes to High level, the APC 1 signal also changes to High level (step 110).

When the LD1 forced light emission signal is output, the laser diode LD1 starts emitting light. A certain time is necessary until the laser diode LD1 emits light in a predetermined amount. That is, the laser diode LD1 has the output waveform shown in FIG. 4.

When a predetermined time has elapsed, and APC is ended (YES in step 111), the main control unit 51 instructs the polygon motor driver 37 to rotate the polygon motor 36 (step 112). More specifically, the main control unit 51 supplies a polygon motor ON signal of High level to the polygon motor driver 37. Accordingly, the polygon motor driver 37 starts rotating the polygon motor 36. In addition, the polygon motor driver 37 detects that the rotational speed of the polygon motor 36 has reached a predetermined rotational speed and outputs a PLLEN signal to the main control unit 51. That is, the polygon motor driver 37 detects that the rotational speed of the polygon motor 36 has reached a predetermined rotational speed and changes the PLLEN signal from Low level to High level.

The light beam having a predetermined light amount is reflected by the polygon mirror 35 and scans the surface of the beam detection sensor 38. When the light beam scans the surface of the beam detection sensor 38, the beam detection circuit 40 detects this scanning and outputs the horizontal sync signal (HSYNC). When it is detected that the horizontal sync signal (HSYNC) is output a predetermined number of times (YES in step 113), and the PLLEN signal changes to High level (YES in step 114), LD1 forced light emission is canceled (changes from Low level to High level) (step 115), and the operation shifts to the APC operations of the laser diodes LD1 and LD2 by the timers T1 and T3 (step 116 and step 117). After that, the light emission timings of the laser diodes LD1 and LD2 are controlled on the basis of, e.g., odd-line image data (DATA1) and even-line image data (DATA2). Accordingly, an electrostatic latent image is formed on the photosensitive drum 15. This electrostatic latent image is transferred to a predetermined paper sheet (step 118).

As described above, the light beam scanning apparatus of the present invention executes APC 1 in which forced light emission is started before the rotational speed of the polygon motor 36 reaches a predetermined rotational speed, and in correspondence with this forced light emission, the amount of the light beam is controlled to a predetermined value. When the light beam corresponding to image data is to be scanned, i.e., when an image is to be formed, the rotational speed of the polygon motor 36 must have reached a predetermined rotational speed, and the rotation of the polygon motor 36 must have stabilized. On the other hand, APC can be executed without any problem even before the rotational speed of the polygon motor 36 reaches the predetermined rotational speed. Hence, an APC lead-in operation is started before the rotational speed of the polygon motor 36 reaches the predetermined rotational speed. That is, the APC lead-in operation is executed by using the standby time necessary until the rotational speed of the polygon motor 36 stabilizes. With this arrangement, the standby time from the start of rotation of the polygon motor 36 to the start of image formation can be shortened.

As an example of the timing at which forced light emission is started before the rotational speed of the polygon motor 36 reaches the predetermined rotational speed, a case wherein the rotation of the polygon motor is started after the start of forced light emission has been described.

Figure 6:
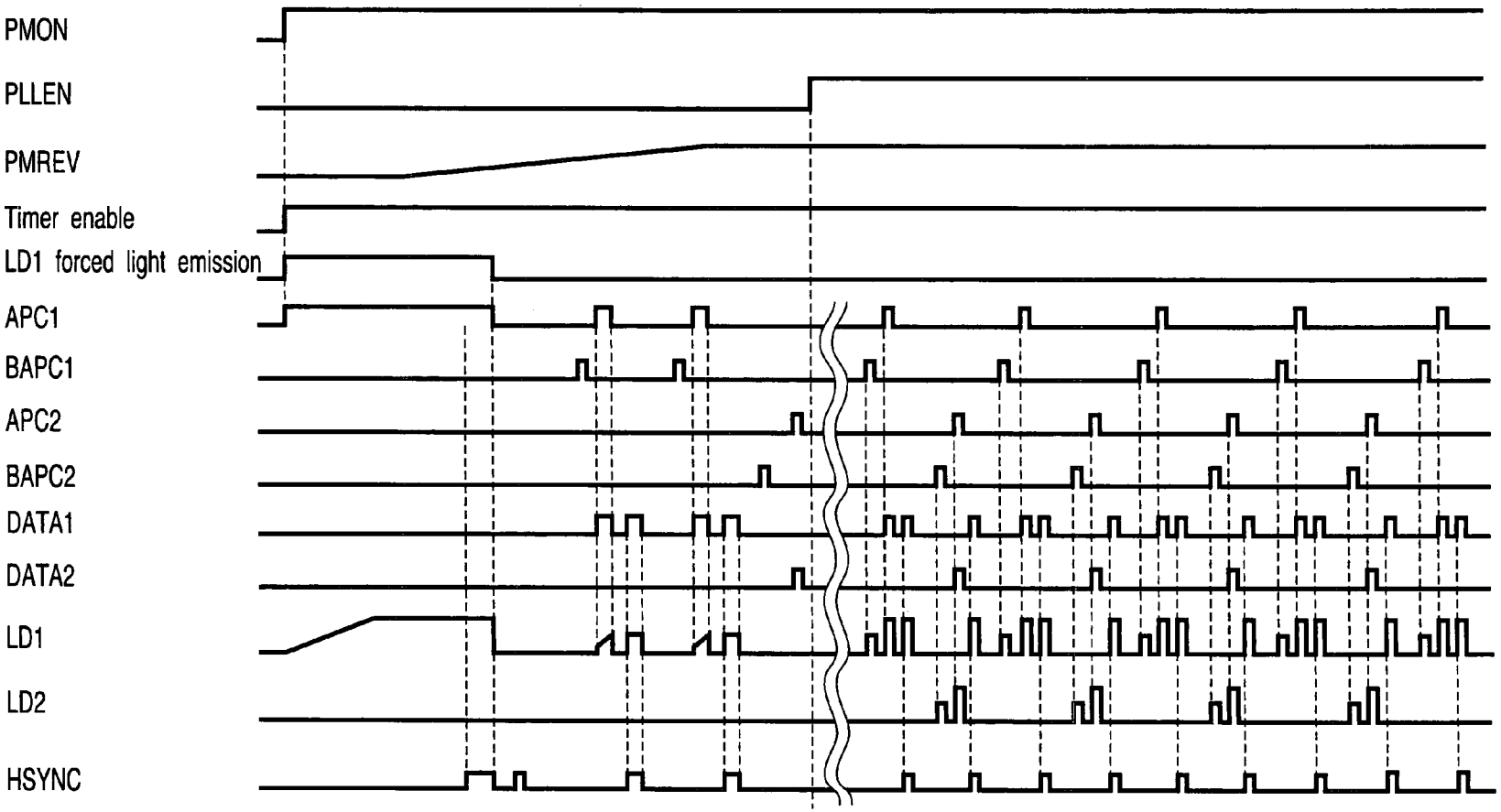
FIG. 6 is a timing chart for explaining detailed example 1 of the APC execution timing by the multi-beam scanning apparatus (the image forming apparatus to which the multi-beam scanning apparatus is applied) described in FIGS. 1 and 3.
Figure 7:
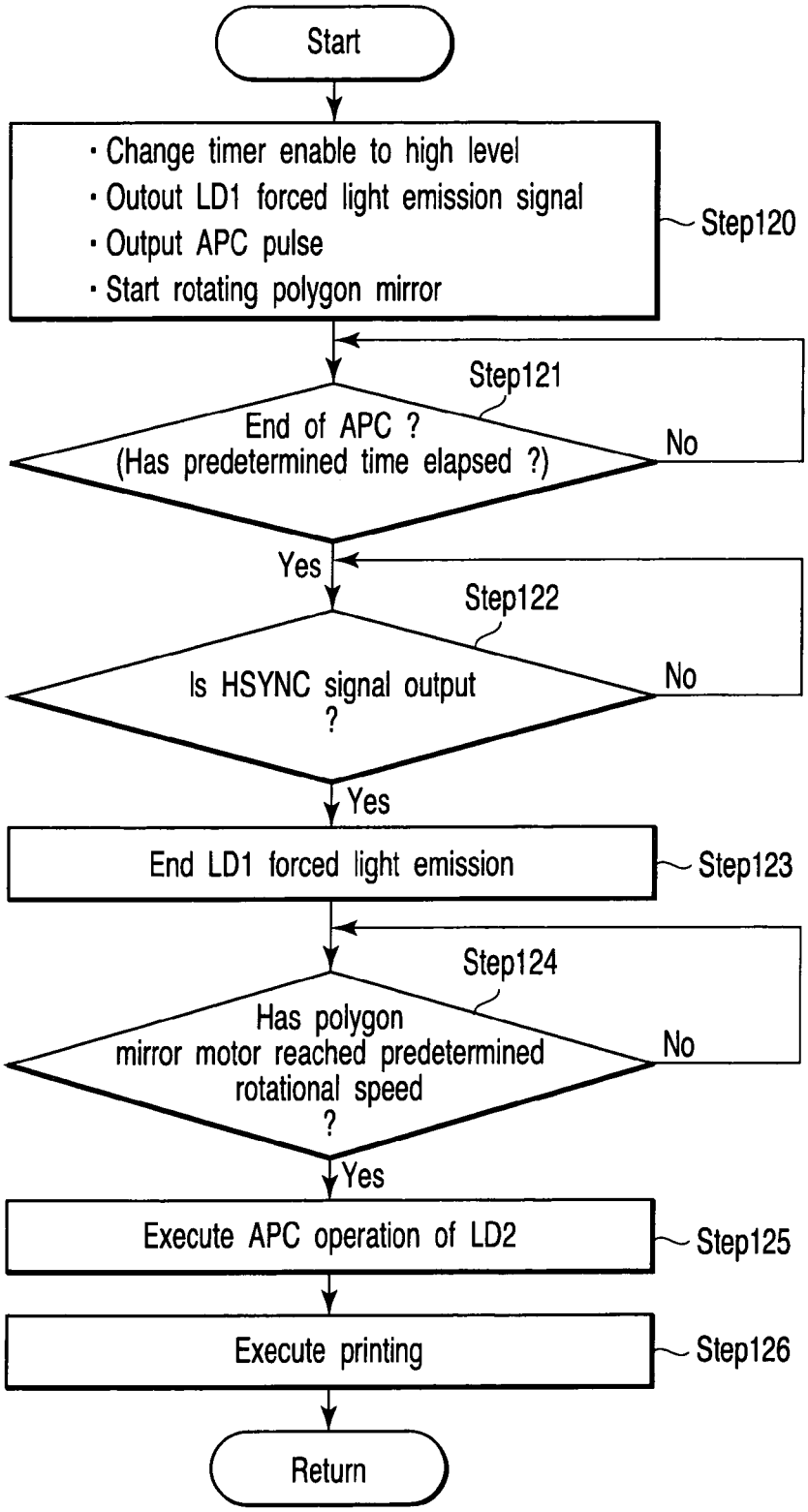
FIG. 7 is a flowchart for explaining detailed example 1 of the APC execution timing corresponding to the timing chart shown in FIG. 4.

FIG. 6 is a timing chart for explaining detailed example 1 of the APC execution timing by the multi-beam scanning apparatus (the image forming apparatus to which the multi-beam scanning apparatus is applied) described in FIGS. 1 and 3. FIG. 7 is a flowchart for explaining detailed example 1 of the APC execution timing corresponding to the timing chart shown in FIG. 4. In detailed example 1 of the APC execution timing, APC 1 is executed in which forced light emission is started simultaneously with the start of rotation of the polygon motor 36 (forced light emission is started in correspondence with the rotation start timing of the polygon motor 36), and in correspondence with this forced light emission, the amount of the light beam is controlled to a predetermined value. Points that are different from the description of FIGS. 4 and 5 will mainly be described below.

The main control unit 51 changes the timer enable signal from Low level to High level (step 120) to output the LD forced light emission signal (step 120). As the LD1 forced light emission signal is output, the APC 1 signal also changes to High level (step 120). Simultaneously, the main control unit 51 instructs the polygon motor driver 37 to rotate the polygon motor 36 (step 120). Accordingly, the polygon motor driver 37 starts rotating the polygon motor 36.

After that, when the time until the light amount of the laser reaches a predetermined light amount has elapsed, APC is ended (YES in step 121). When it is detected that the horizontal sync signal is output a predetermined number of times (YES in step 122), LD1 forced light emission is canceled (step 123). The operation shifts to the APC operation by the timer T1.

Upon detecting that the rotational speed of the polygon motor 36 has reached a predetermined rotational speed (YES in step 124), the polygon motor driver 37 outputs a PLLEN signal of High level to the main control unit 51. Subsequently, the operation shifts to the APC operation of the laser diode LD2 by the timer T3 (step 125). After that, the light emission timings of the laser diodes LD1 and LD2 are controlled on the basis of, e.g., odd-line image data (DATA1) and even-line image data (DATA2). Accordingly, an electrostatic latent image is formed on the photosensitive drum 15. This electrostatic latent image is transferred to a predetermined paper sheet (step 126).

As described above, the APC lead-in operation is started simultaneously with the start of rotation of the polygon motor. Generally, the "time necessary until the polygon motor (polygon mirror) reaches a predetermined rotational speed" is longer than the "time necessary until the laser reaches a predetermined light amount". For this reason, actually, the "time necessary until the polygon motor (polygon mirror) reaches a predetermined rotational speed" is the "time necessary until the polygon motor (polygon mirror) in a stopped state is set in a state capable of emitting a light beam corresponding to desired image data". More specifically, when the APC lead-in operation is started simultaneously with the start of rotation of the polygon motor (polygon mirror), as described above, the standby time until the polygon motor (polygon mirror) in a stopped state is set in the state capable of emitting a light beam corresponding to desired image data can be shortened.

The APC 1 start timing may be controlled in the following way. For example, APC 1 is executed in which forced light emission is started after the elapse of a predetermined time from the start of rotation of the polygon motor, and in correspondence with this forced light emission, the amount of the light beam is controlled to a predetermined value. The predetermined time is shorter than a time obtained by subtracting the "time after the laser forced light emission start signal is output until the laser emits light in a predetermined light amount" from the "time necessary until the polygon motor reaches a predetermined rotational speed". As a result, even when forced light emission is started after the elapse of the predetermined time from the start of rotation of the polygon motor, the APC lead-in operation is ended before the polygon motor reaches the predetermined rotational speed. Hence, the standby time from the start of rotation of the polygon motor to the start of image formation can be shortened.

Figure 8:
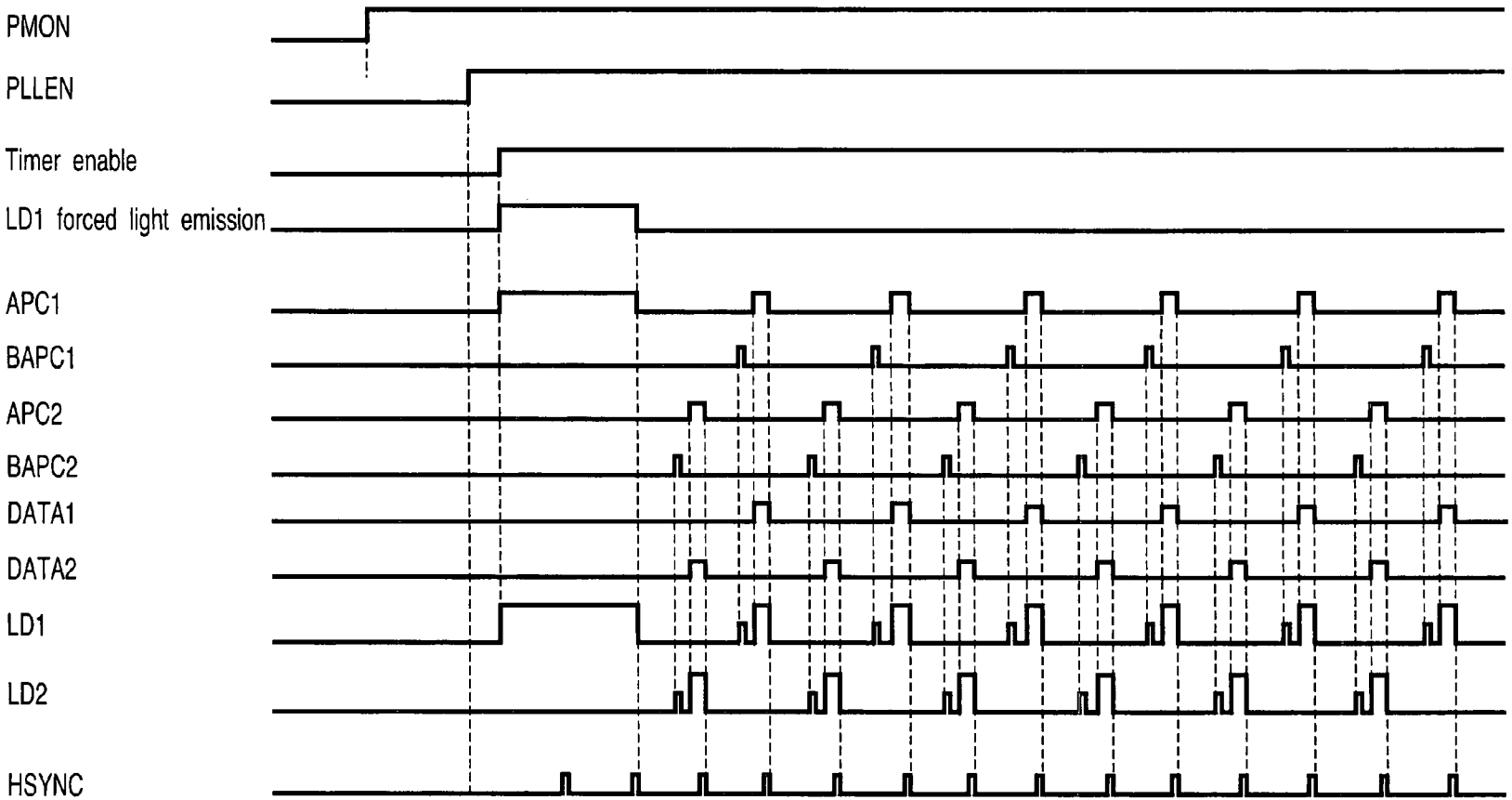
FIG. 8 is a timing chart showing a comparative example so as to explain the effect for shortening the standby time from the start of rotation of the polygon motor to the start of image formation by the light beam scanning apparatus (the image forming apparatus to which the multi-beam scanning apparatus is applied) according to the present invention.

FIG. 8 is a timing chart showing a comparative example so as to explain the effect for shortening the standby time from the start of rotation of the polygon motor to the start of image formation by the light beam scanning apparatus (the image forming apparatus to which the multi-beam scanning apparatus is applied) according to the present invention. That is, FIG. 8 is a timing chart showing processing for starting the APC lead-in operation after the rotational speed of the polygon motor reaches a predetermined rotational speed and stabilizes. A predetermined time is necessary until the rotational speed of the polygon motor reaches a predetermined rotational speed and stabilizes. For example, when the polygon motor that is set in a stopped state in a power saving mode or the like is reactivated, some standby time is generated until the start of APC. As a result, the standby time from reactivation to image formation is long.

The second embodiment of the present invention will be described next with reference to FIGS. 9 to 17. In the second embodiment, a single-beam type light beam scanning apparatus which forms an image by one light beam and an image forming apparatus to which the single-beam type light beam scanning apparatus is applied will be described.

Figure 9:
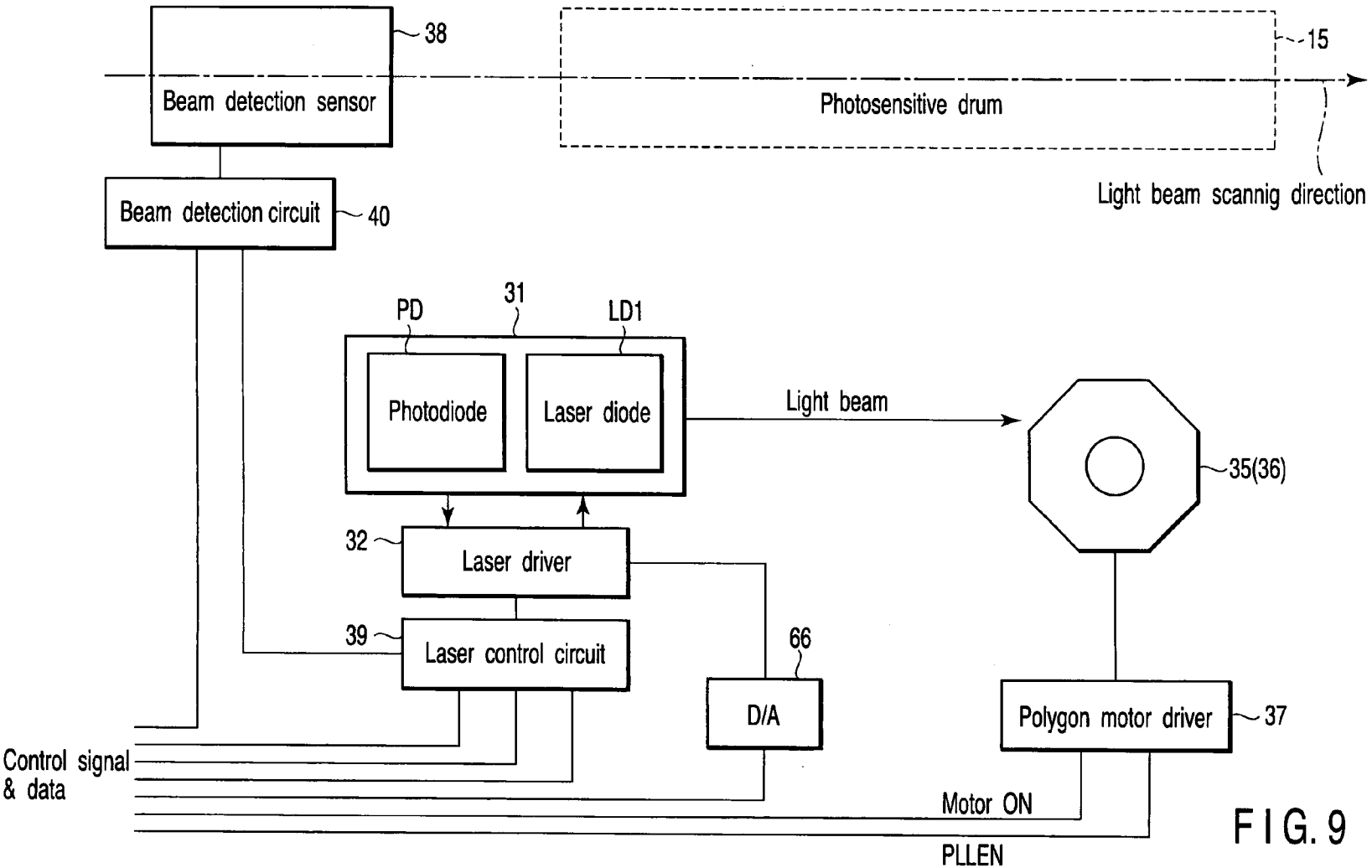
FIG. 9 is a view showing the schematic arrangement of a single-beam type light beam scanning apparatus according to another embodiment of the present invention and the positional relationship between the light beam scanning apparatus and a photosensitive drum.
Figure 10:
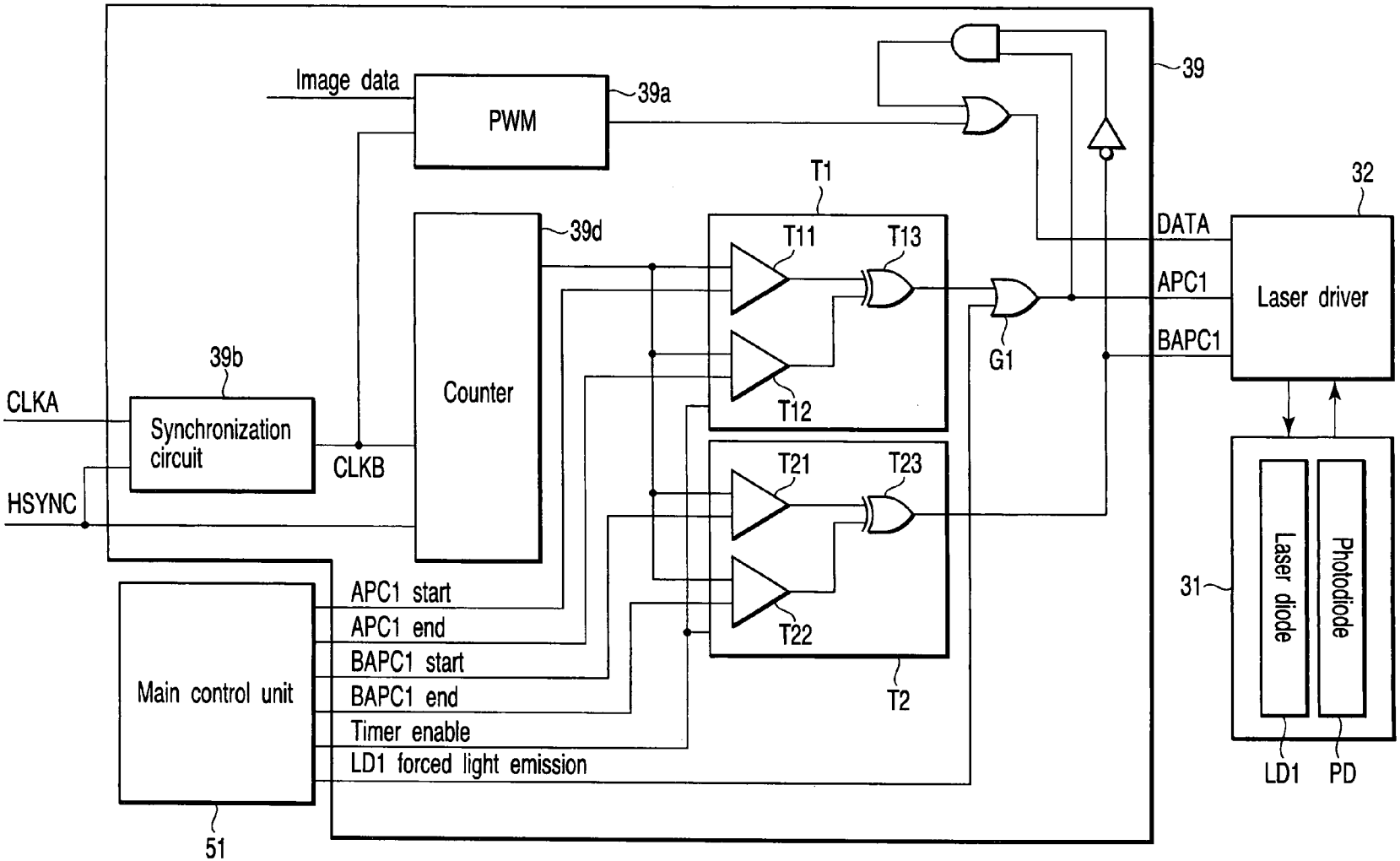
FIG. 10 is a block diagram showing the detailed arrangement of a laser control circuit applied to the single-beam type light beam scanning apparatus.

FIG. 9 is a view showing the schematic arrangement of a single-beam type light beam scanning apparatus according to the embodiment of the present invention and the positional relationship between the light beam scanning apparatus and a photosensitive drum. FIG. 10 is a block diagram showing the detailed arrangement of a laser control circuit applied to the single-beam type light beam scanning apparatus. The basic arrangement of the single-beam type light beam scanning apparatus corresponds to that of the multi-beam type light beam scanning apparatus. Hence, for the single-beam type light beam scanning apparatus, only points that are different from the multi-beam type light beam scanning apparatus will be described. Similarly, the basic arrangement of the image forming apparatus to which the single-beam type light beam scanning apparatus is applied corresponds to that of the image forming apparatus to which the multi-beam type light beam scanning apparatus is applied. The image forming apparatus to which the single-beam type light beam scanning apparatus is applied will only be described with reference to FIG. 2 as needed.

As shown in FIG. 9, a laser array 31 comprises a laser diode LD1 serving as a light emission means (light source) and a photodiode PD. The photodiode PD detects the laser light amount. The light emission power (light amount) and light emission timing of the laser diode LD1 are controlled by a laser driver 32. The laser driver 32 incorporates an auto power control (APC) circuit and causes the laser diode LD1 to emit light at a light emission power level set from a main control unit (CPU) 51 shown in FIG. 2. The laser driver 32 controls the light emission timing of the laser diode LD1 on the basis of image data. In executing auto power control, the light amounts of the laser diodes LD1 and LD2 are controlled on the basis of the light amount detected by the photodiode PD.

A beam detection sensor 38 detects the passage position and passage timing of a light beam and its power on the surface (a position equivalent to the surface of a photosensitive drum 14) of the photosensitive drum 14. The sensor signal from the beam detection sensor 38 is input to a beam detection circuit 40. On the basis of a detection result from the beam detection circuit 40, the light emission power and light emission timing of the laser diode LD1 are controlled.

A laser control circuit 39 controls the light emission timing of the laser diode LD1. A D/A converter 66 outputs a reference voltage such that the laser driver 32 causes the laser diode LD1 to emit light in a predetermined light amount. The main control unit 51 instructs the reference voltage to the D/A converter 66 by a digital value. The D/A converter 66 converts the reference voltage instructed by the digital values into an analog value.

APC will be described next. The main control unit 51 supplies an APC start signal, APC end signal, BAPC start signal, BAPC end signal, timer enable signal, and LD 1 forced light emission signal to the laser control circuit 39. On the basis of the supplied signals, the laser control circuit 39 controls forced light beam emission at a predetermined timing outside the control period (outside the image area) of the light beam emission timing based on image data. On the basis of a light amount detection result detected in correspondence with the forced light emission, the main control unit 51 outputs a light amount control signal that controls the amount of the light beam to a predetermined value. The laser control circuit 39 controls the light amount of the laser diode LD1 on the basis of the light amount control signal output from the main control unit.

As shown in FIG. 10, the laser control circuit 39 comprises a PWM (Pulse Width Modulator) 39*a*, synchronization circuit 39*c*, counter 39*d*, timers T1 and T2, and OR gate G1. The light beam scanning apparatus having the laser control circuit 39 shown in FIG. 10 can freely generate the APC signal and BAPC signal between a horizontal sync signal (HSYNC) and the next horizontal sync signal (HSYNC) by counting an image clock (CLKB) synchronized with the horizontal sync signal (HSYNC) and setting predetermined comparative reference values (timings that are prepared in advance) for the timers T1 and T2. As described above, since the APC signal can freely be generated, the light emission timing of the laser oscillator 31 can freely be controlled.

Figure 11:
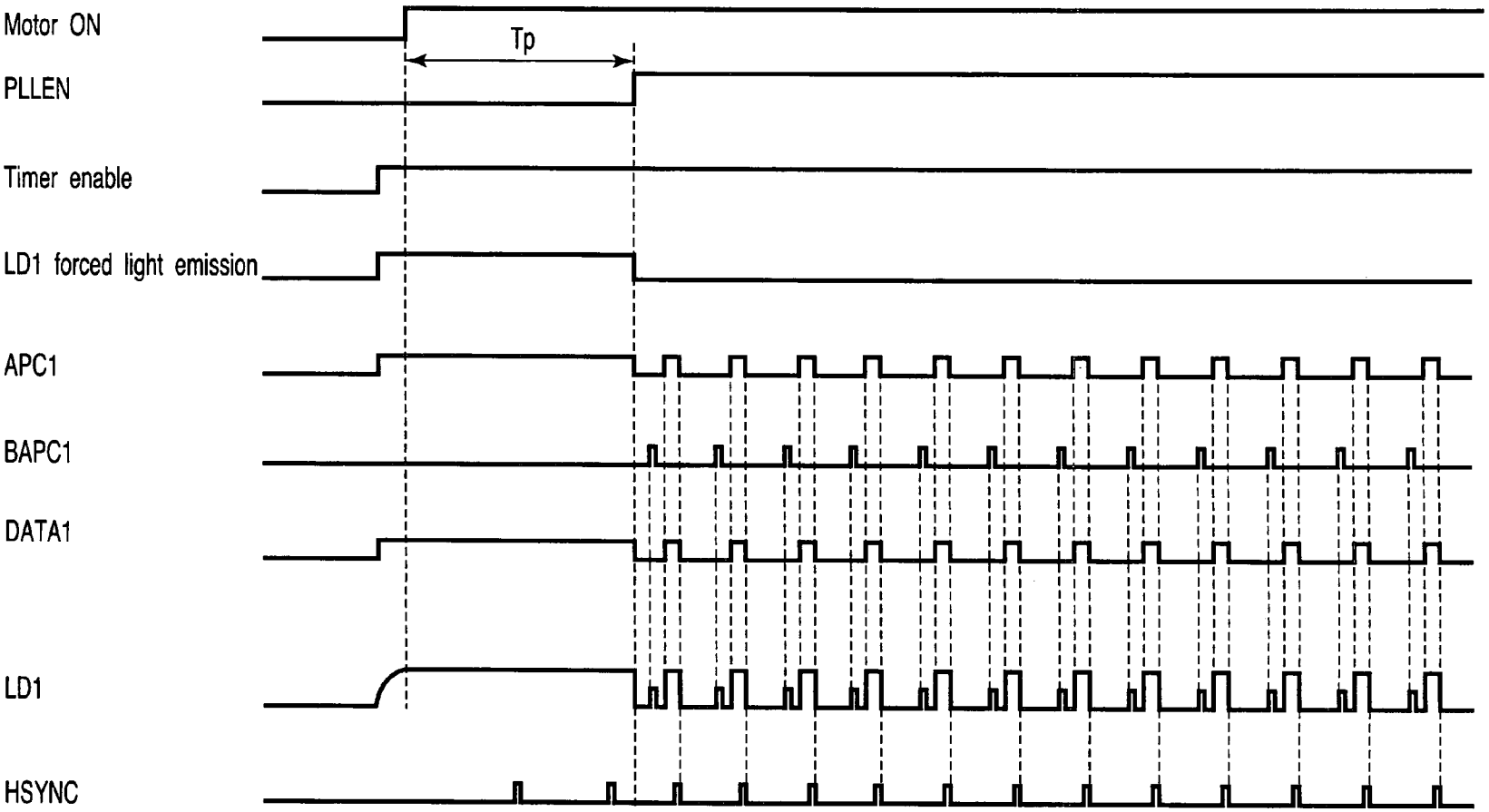
FIG. 11 is a timing chart for explaining the APC execution timing by the single-beam scanning apparatus (an image forming apparatus to which the single-beam scanning apparatus is applied) described in FIGS. 9 and 10.
Figure 12:
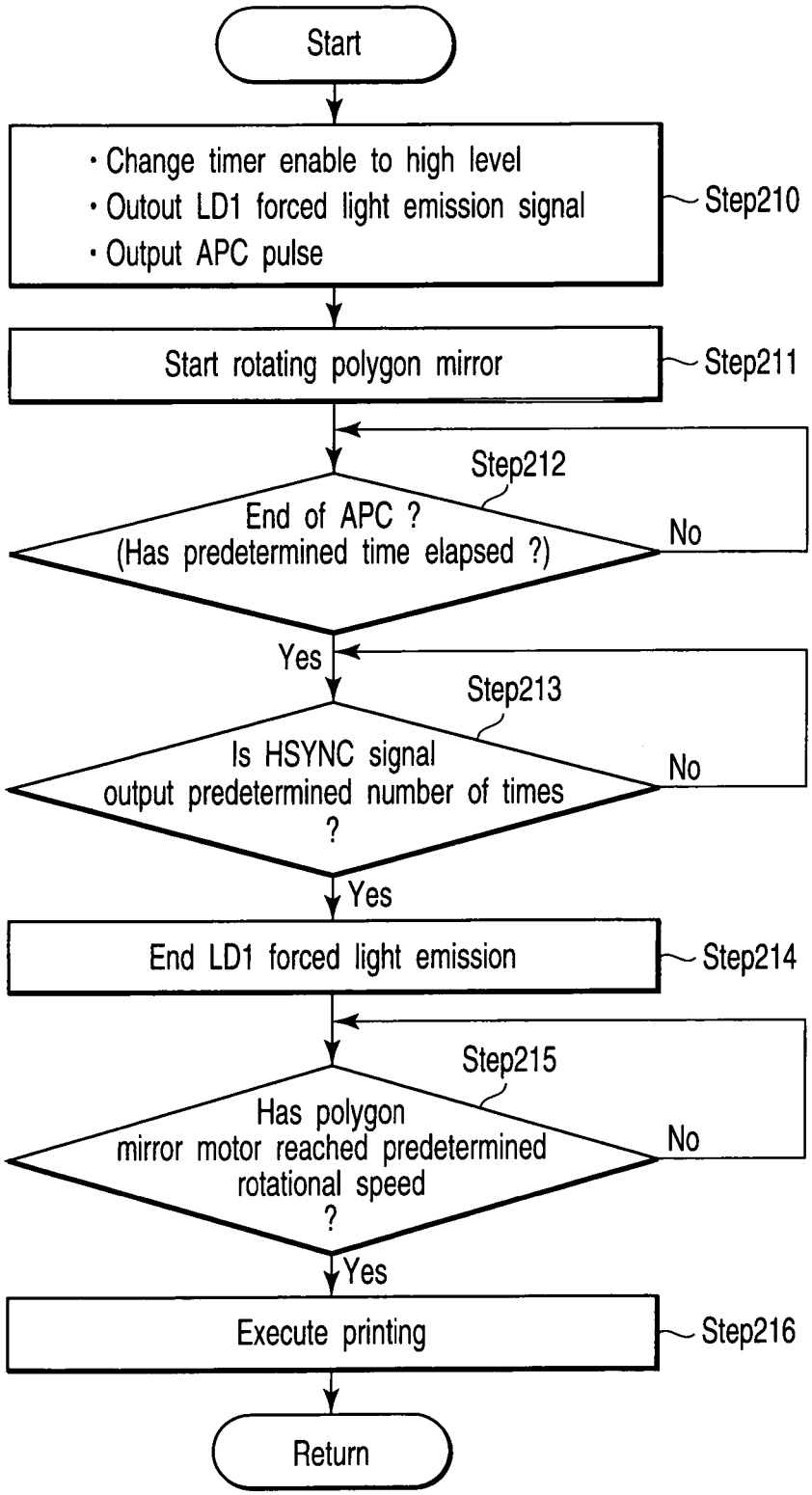
FIG. 12 is a flowchart for explaining the APC execution timing corresponding to the timing chart shown in FIG. 11.

FIG. 11 is a timing chart for explaining the APC execution timing by the single-beam scanning apparatus (the image forming apparatus to which the single-beam scanning apparatus is applied) described in FIGS. 9 and 10. FIG. 12 is a flowchart for explaining the APC execution timing corresponding to the timing chart shown in FIG. 11. In this APC execution timing, APC is executed in which forced light emission is started before the rotational speed of the polygon motor 36 reaches a predetermined rotational speed, and in correspondence with this forced light emission, the amount of the light beam is controlled to a predetermined value. Details will be described below.

The main control unit 51 validates the operations of the timers T1 and T2 which control the APC timing. That is, the main control unit 51 changes the timer enable signal from Low level to High level (step 210). The timer enable signal is always maintained in the High level state while the operations of the timers T1 and T2 are validated.

Simultaneously, the main control unit 51 outputs an LD1 forced light emission signal to the laser driver 32 (step 210) to forcibly cause the laser diode LD1 to emit light. That is, the main control unit 51 changes the LD1 forced light emission signal from Low level to High level. The LD1 forced light emission signal is input to the laser driver 32 through the OR gate G1 as the APC 1 signal. That is, when the LD1 forced light emission signal changes to High level, the APC 1 signal also changes to High level (step 210).

When the LD1 forced light emission signal is output, the laser diode LD1 starts emitting light. A certain time is necessary until the laser diode LD1 emits light in a predetermined amount. That is, the laser diode LD1 has the output waveform shown in FIG. 11.

Next, the main control unit 51 instructs a polygon motor driver 37 to rotate a polygon motor 36 (step 211). More specifically, the main control unit 51 supplies a polygon motor ON signal of High level to the polygon motor driver 37. Accordingly, the polygon motor driver 37 starts rotating the polygon motor 36.

The main control unit 51 counts the time from the output of the LD1 forced light emission signal and counts the time until the light amount of the laser reaches a predetermined light amount. When the time until the light amount of the laser reaches the predetermined light amount has elapsed, APC is ended (YES in step 212). When it is detected that the horizontal sync signal is output a predetermined number of times (YES in step 213), LD1 forced light emission is canceled (changes from Low level to High level) (step 214). Then, the operation shifts to the APC operation by the timer T1.

Upon detecting that the rotational speed of the polygon motor 36 has reached the predetermined rotational speed (YES in step 215), the polygon motor driver 37 outputs a PLLEN signal of high level to the main control unit 51. Upon receiving the PLLEN signal of high level, the main control unit 51 detects that the rotational speed of the polygon motor 36 has reached the predetermined rotational speed. After that, the light emission timing of the laser diode LD1 is controlled on the basis of image data (DATA1). Accordingly, an electrostatic latent image is formed on the photosensitive drum 15. This electrostatic latent image is transferred to a predetermined paper sheet (step 216).

As described above, the light beam scanning apparatus of the present invention executes APC 1 in which forced light emission is started before the rotational speed of the polygon motor 36 reaches a predetermined rotational speed, and in correspondence with this forced light emission, the amount of the light beam is controlled to a predetermined value. When the light beam corresponding to image data is to be scanned, i.e., when an image is to be formed, the rotational speed of the polygon motor 36 must have reached a predetermined rotational speed, and the rotation of the polygon motor 36 must have stabilized. On the other hand, APC can be executed without any problem even before the rotational speed of the polygon motor 36 reaches the predetermined rotational speed. Hence, an APC lead-in operation is started before the rotational speed of the polygon motor 36 reaches the predetermined rotational speed. That is, the APC lead-in operation is executed by using the standby time necessary until the rotational speed of the polygon motor 36 stabilizes. With this arrangement, the standby time from the start of rotation of the polygon motor 36 to the start of image formation can be shortened.

As an example of the timing at which forced light emission is started before the rotational speed of the polygon motor 36 reaches the predetermined rotational speed, a case wherein the rotation of the polygon motor is started after the start of forced light emission has been described.

Figure 13:
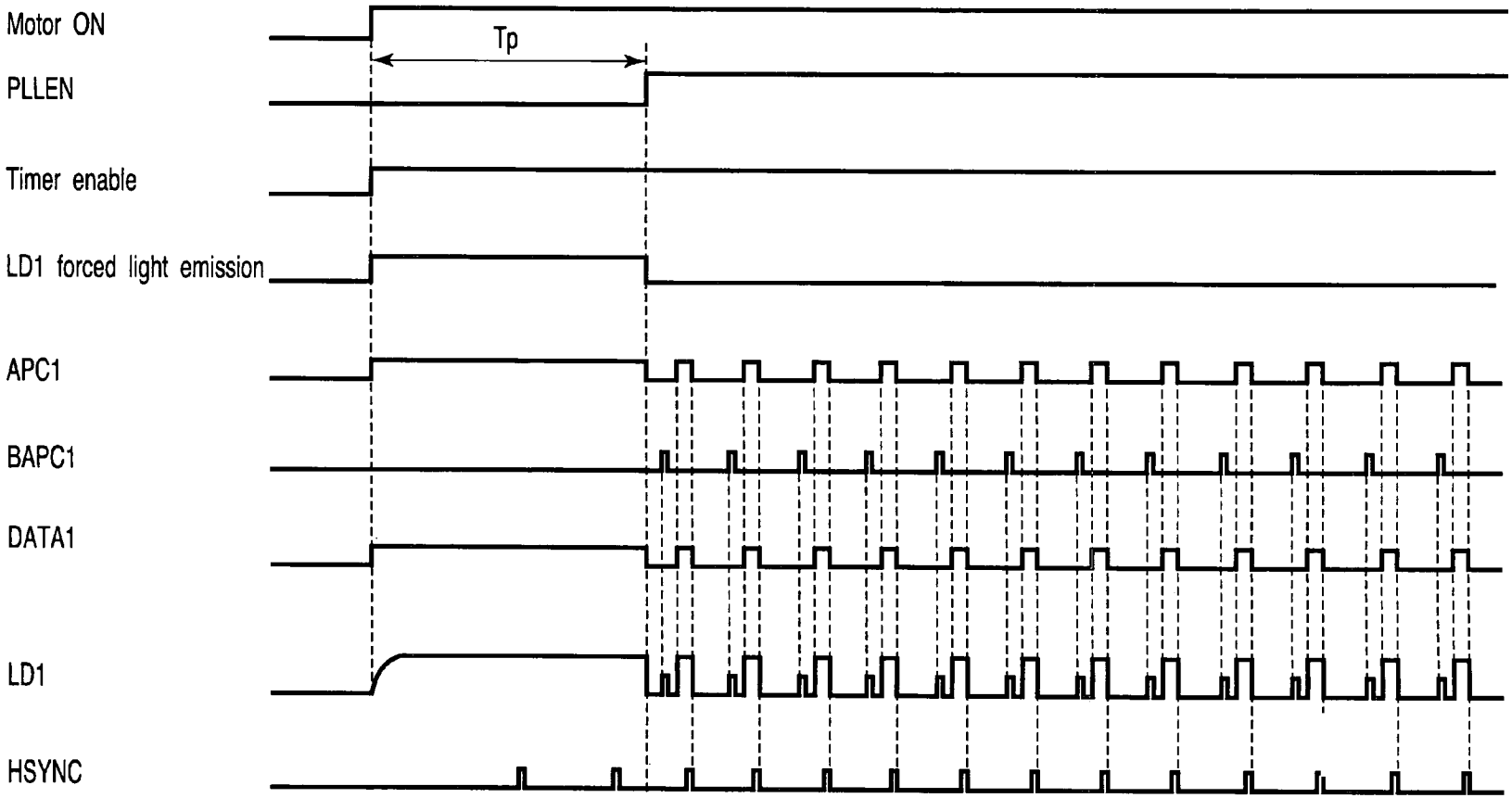
FIG. 13 is a timing chart for explaining detailed example 1 of the APC execution timing by the single-beam scanning apparatus (the image forming apparatus to which the single-beam scanning apparatus is applied) described in FIGS. 9 and 10.
Figure 14:
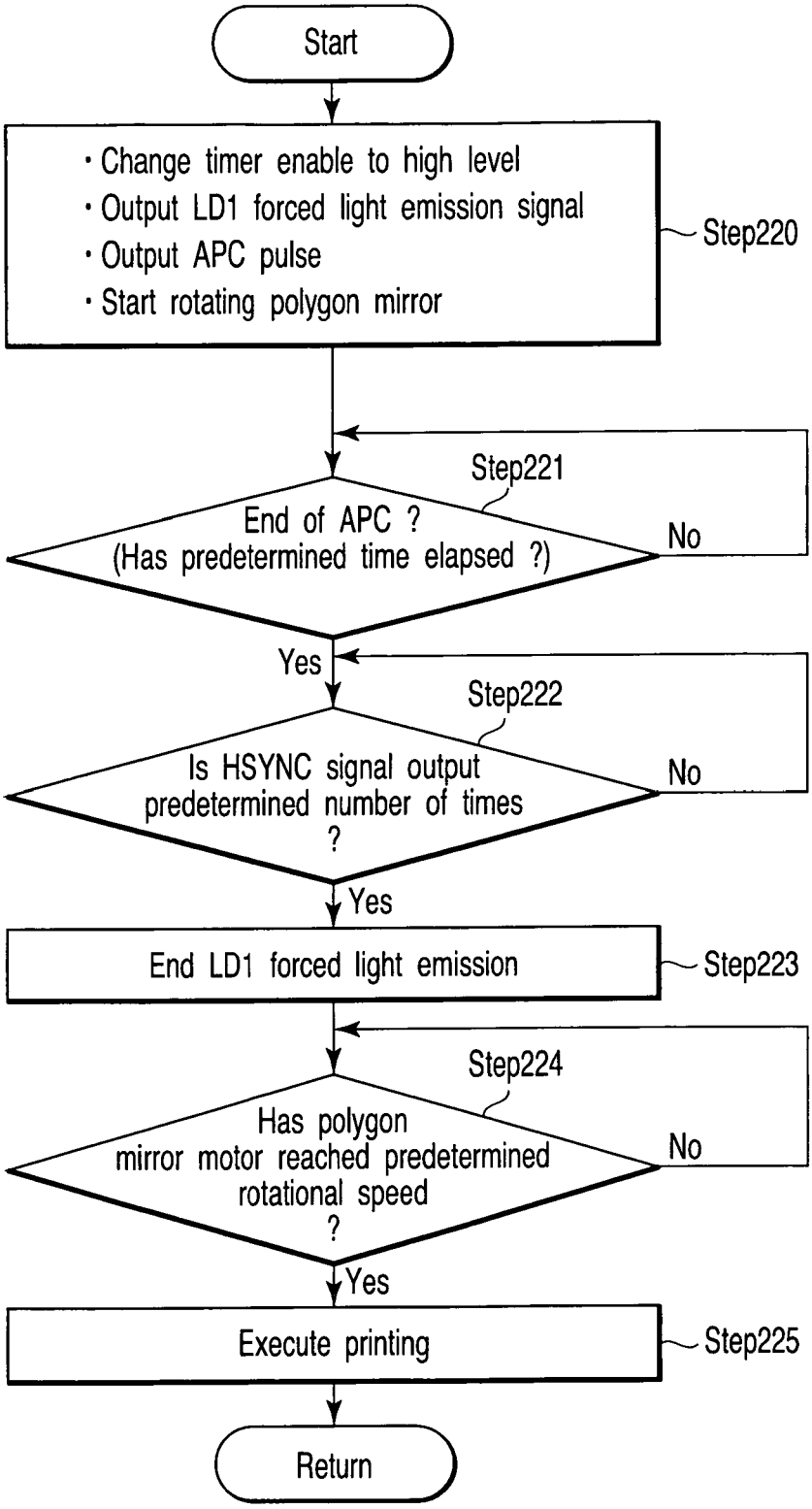
FIG. 14 is a flowchart for explaining detailed example 1 of the APC execution timing corresponding to the timing chart shown in FIG. 13.

FIG. 13 is a timing chart for explaining detailed example 1 of the APC execution timing by the single-beam scanning apparatus (the image forming apparatus to which the single-beam scanning apparatus is applied) described in FIGS. 9 and 10. FIG. 14 is a flowchart for explaining detailed example 1 of the APC execution timing corresponding to the timing chart shown in FIG. 13. In detailed example 1 of the APC execution timing, APC 1 is executed in which forced light emission is started simultaneously with the start of rotation of the polygon motor 36 (forced light emission is started in correspondence with the rotation start timing of the polygon motor 36), and in correspondence with this forced light emission, the amount of the light beam is controlled to a predetermined value. Points that are different from the description of FIGS. 11 and 12 will mainly be described below.

The main control unit 51 changes the timer enable signal from Low level to High level (step 220) to output the LD forced light emission signal (step 220). As the LD1 forced light emission signal is output, the APC 1 signal also changes to High level (step 220). Simultaneously, the main control unit 51 instructs the polygon motor driver 37 to rotate the polygon motor 36 (step 220). Accordingly, the polygon motor driver 37 starts rotating the polygon motor 36.

After that, when the time until the light amount of the laser reaches a predetermined light amount has elapsed, APC is ended (YES in step 221). When it is detected that the horizontal sync signal is output a predetermined number of times (YES in step 222), LD1 forced light emission is canceled (step 223). The operation shifts to the APC operation by the timer T1.

Upon detecting that the rotational speed of the polygon motor 36 has reached a predetermined rotational speed (YES in step 224), the polygon motor driver 37 outputs a PLLEN signal of High level to the main control unit 51. After that, the light emission timing of the laser diode LD1 is controlled on the basis of image data (DATA1). Accordingly, an electrostatic latent image is formed on the photosensitive drum 15. This electrostatic latent image is transferred to a predetermined paper sheet (step 225).

As described above, the APC lead-in operation is started simultaneously with the start of rotation of the polygon motor. Generally, the "time necessary until the polygon motor (polygon mirror) reaches a predetermined rotational speed" is longer than the "time necessary until the laser reaches a predetermined light amount". For this reason, actually, the "time necessary until the polygon motor (polygon mirror) reaches a predetermined rotational speed" is the "time necessary until the polygon motor (polygon mirror) in a stopped state is set in a state capable of emitting a light beam corresponding to desired image data". More specifically, when the APC lead-in operation is started simultaneously with the start of rotation of the polygon motor (polygon mirror), as described above, the standby time until the polygon motor (polygon mirror) in a stopped state is set in the state capable of emitting a light beam corresponding to desired image data can be shortened.

Figure 15:
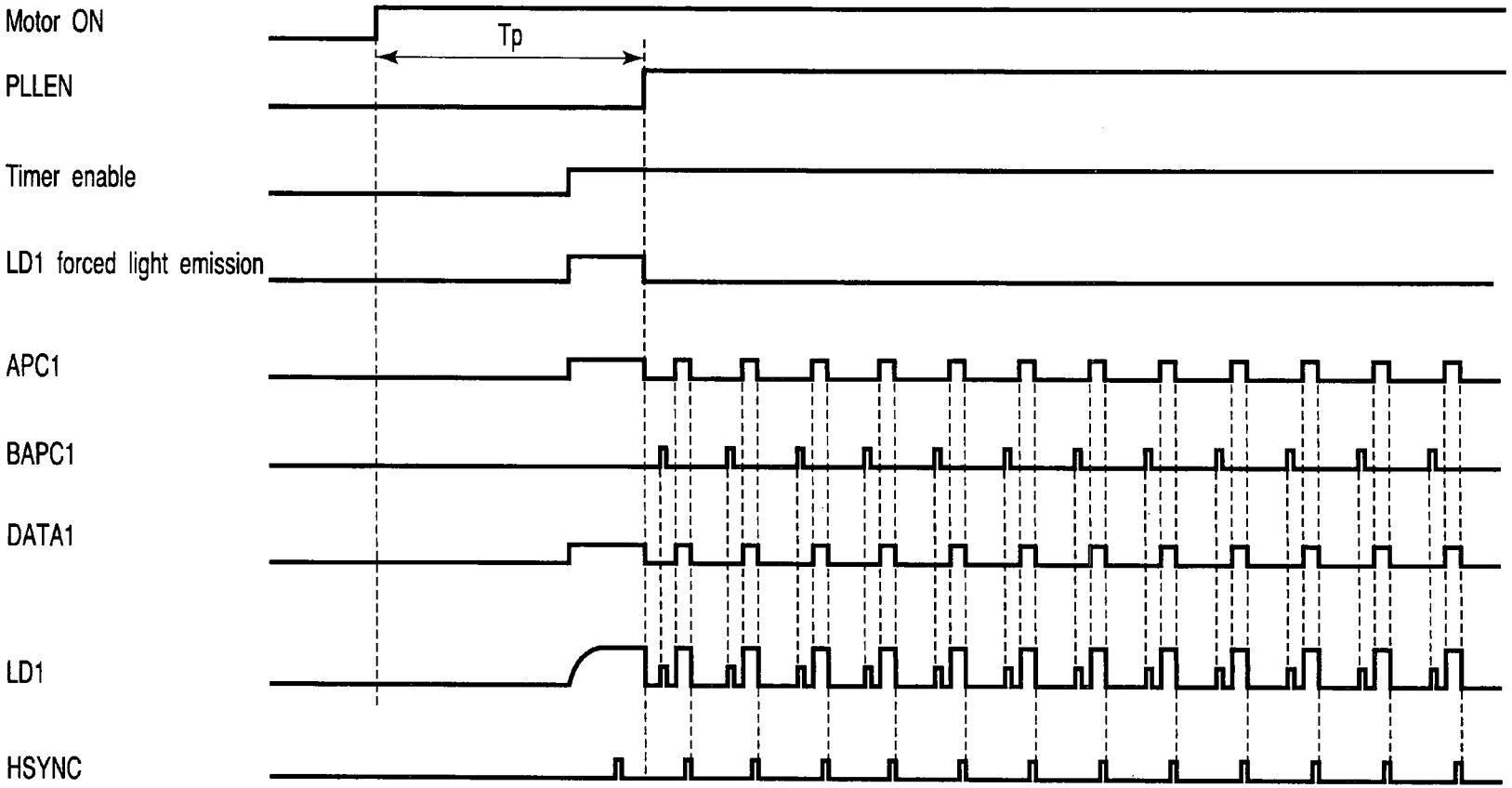
FIG. 15 is a timing chart for explaining detailed example 2 of the APC execution timing by the single-beam scanning apparatus (the image forming apparatus to which the single-beam scanning apparatus is applied) described in FIGS. 9 and 10.
Figure 16:
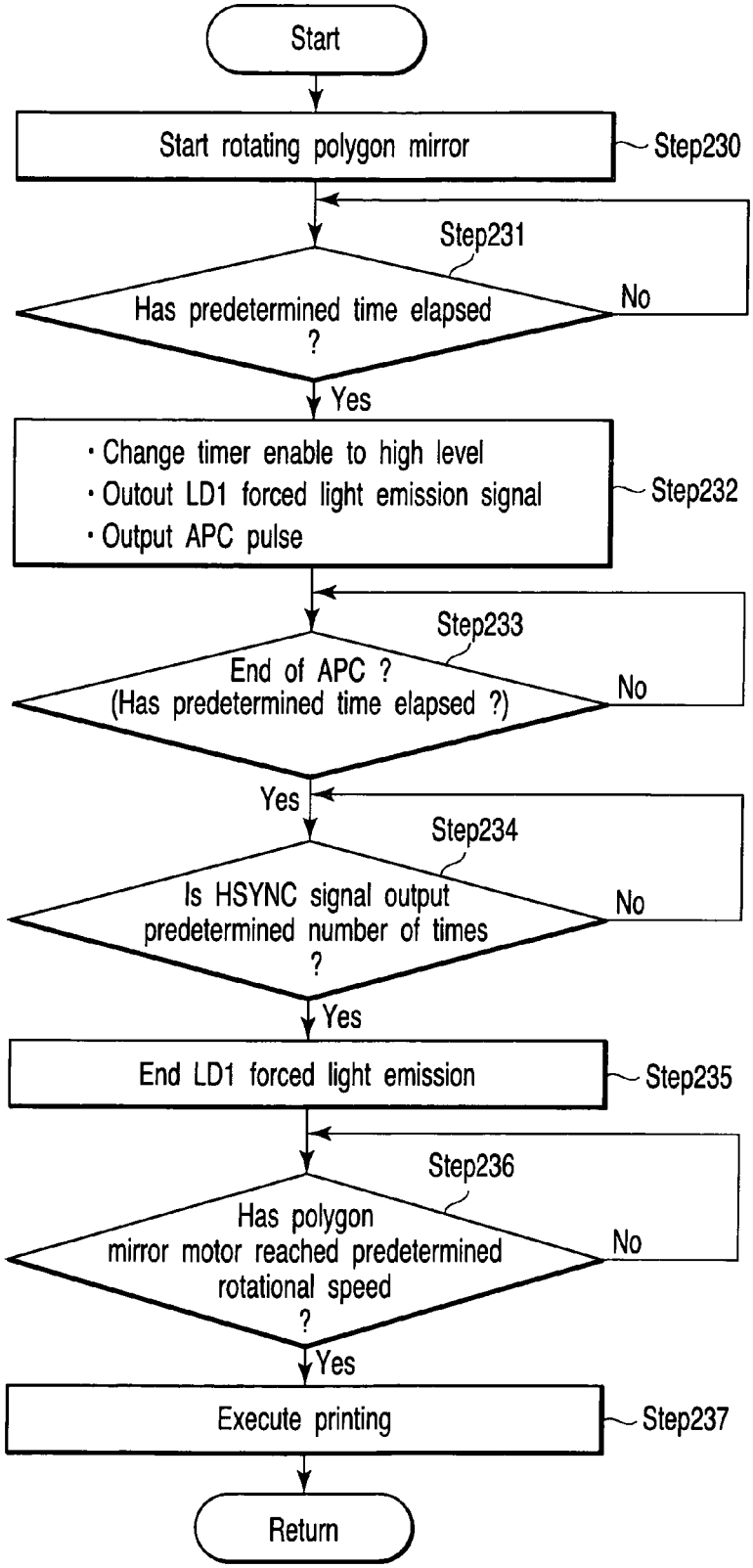
FIG. 16 is a flowchart for explaining detailed example 2 of the APC execution timing corresponding to the timing chart shown in FIG. 15.

FIG. 15 is a timing chart for explaining detailed example 2 of the APC execution timing by the single-beam scanning apparatus (the image forming apparatus to which the single-beam scanning apparatus is applied) described in FIGS. 9 and 10. FIG. 16 is a flowchart for explaining detailed example 2 of the APC execution timing corresponding to the timing chart shown in FIG. 15. In detailed example 2 of the APC execution timing, APC 1 is executed in which forced light emission is started after the elapse of a predetermined time from the start of rotation of the polygon motor 36, and in correspondence with this forced light emission, the amount of the light beam is controlled to a predetermined value. Points that are different from the description of FIGS. 11 and 12 will mainly be described below.

The main control unit 51 instructs the polygon motor driver 37 to rotate the polygon motor 36 (step 230). More specifically, the main control unit 51 supplies a polygon motor ON signal of High level to the polygon motor driver 37. Accordingly, the polygon motor driver 37 starts rotating the polygon motor 36.

The main control unit 51 counts the time from the output of the polygon motor rotation start signal. The main control unit 51 counts the time until a predetermined time has elapsed. In this embodiment, the predetermined time is shorter than a time obtained by subtracting the "time after the laser forced light emission start signal is output until the laser emits light in a predetermined light amount" from the "time necessary until the polygon motor reaches a predetermined rotational speed".

When the predetermined time has elapsed (YES in step 231), the main control unit 51 changes the timer enable signal from Low level to High level (step 232) to output the LD1 forced light emission signal (step 232). When the LD1 forced light emission signal is output, the APC 1 signal also changes to High level (step 232).

When the time until the light amount of the laser reaches a predetermined light amount has elapsed, APC is ended (YES in step 233). When it is detected that the horizontal sync signal is output a predetermined number of times (YES in step 234), LD1 forced light emission is canceled (step 235). Then, the operation shifts to the APC operation by the timer T1.

Upon detecting that the rotational speed of the polygon motor 36 has reached the predetermined rotational speed (YES in step 236), the polygon motor driver 37 outputs a PLLEN signal of high level to the main control unit 51. After that, the light emission timing of the laser diode LD1 is controlled on the basis of image data (DATA1). Accordingly, an electrostatic latent image is formed on the photosensitive drum 15. This electrostatic latent image is transferred to a predetermined paper sheet (step 237).

As described above, APC is started after the elapse of the predetermined from the start of rotation of the polygon motor. With this arrangement, the standby time until the polygon motor in a stopped state is set in the state capable of emitting a light beam corresponding to desired image data can be shortened.

Figure 17:
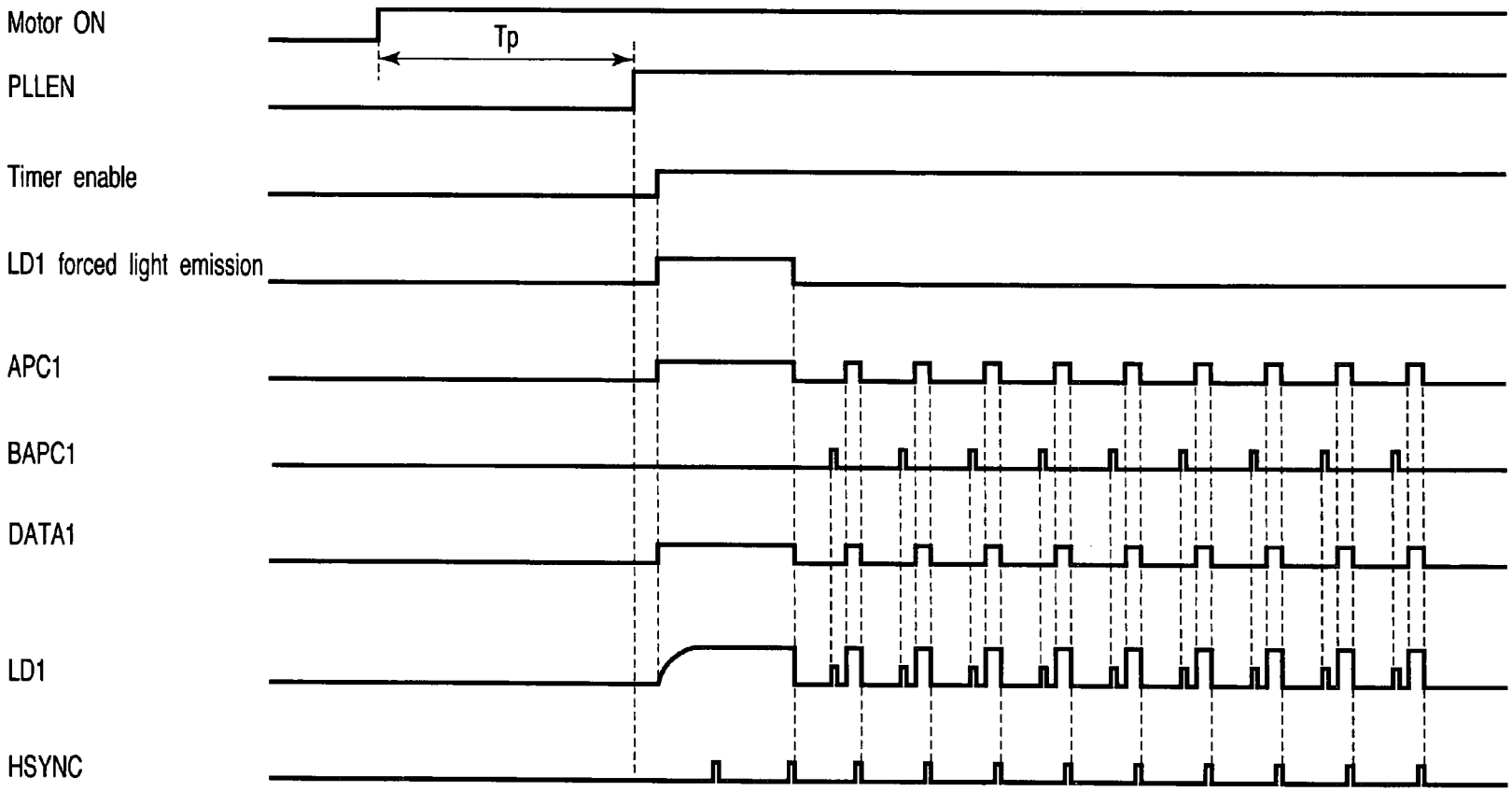
FIG. 17 is a timing chart showing a comparative example so as to explain the effect for shortening the standby time from the start of rotation of the polygon motor to the start of image formation by the light beam scanning apparatus (the image forming apparatus to which the single-beam scanning apparatus is applied) according to the present invention.

FIG. 17 is a timing chart showing a comparative example so as to explain the effect for shortening the standby time from the start of rotation of the polygon motor to the start of image formation by the light beam scanning apparatus (the image forming apparatus to which the single-beam scanning apparatus is applied) according to the present invention. That is, FIG. 17 is a timing chart showing processing for starting the APC lead-in operation after the rotational speed of the polygon motor reaches a predetermined rotational speed and stabilizes. A predetermined time is necessary until the rotational speed of the polygon motor 36 reaches a predetermined rotational speed and stabilizes. For example, when the polygon motor that is set in a stopped state in a power saving mode or the like is reactivated, some standby time is generated until the start of APC. As a result, the standby time from reactivation to image formation is long.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A light beam scanning apparatus comprising:

light emission means for emitting a light beam;

light amount detection means for detecting a light amount of the light beam emitted by the light emission means;

reflection means for reflecting the light beam to scan the light beam emitted by the light emission means;

rotation means for rotating the reflection means to scan the light beam emitted by the light emission means;

rotation control means for controlling rotation of the rotation means;

rotational speed detection means for detecting that a rotational speed of the rotation means has reached a predetermined rotational speed;

light amount control means for, before the rotational speed detection means detects that the rotational speed has reached the predetermined rotational speed, controlling light emission of the light beam by the light emission means at an ON/OFF timing of auto power control on the basis of a count of an image clock synchronized with a horizontal sync signal and controlling the light amount of the light beam emitted by the light emission means to a predetermined value on the basis of a light amount detection result detected by the light amount detection means in correspondence with the light emission;

bias current control means for, before the ON timing of the auto power control, controlling ON/OFF of a bias current supplied to the light emission means at the ON/OFF timing of the bias current on the basis of the count of the image clock synchronized with the horizontal sync signal; and light emission control means for, after the rotational speed detection means detects that the rotational speed has reached the predetermined rotational speed, controlling a light emission timing of the light beam by the light emission means on the basis of horizontal sync signal synchronized with the image clock.

2. The apparatus according to claim 1, wherein the light amount control means starts the light emission of the light beam and starts light amount control of the light beam in correspondence with a timing of a start of rotation of the rotation means by the rotation control means.

3. The apparatus according to claim 1, wherein the light amount control means starts the light emission of the light beam and starts light amount control of the light beam after an elapse of a predetermined time from a timing of a start of rotation of the rotation means by the rotation control means.

4. The apparatus according to claim 3, wherein the predetermined time is shorter than a difference time obtained by subtracting a time necessary after a start of forced light emission of the light beam until the light amount of the light beam reaches a predetermined light amount from a time necessary until the rotation means in a stopped state reaches a predetermined rotational speed.

5. The apparatus according to claim 1, wherein the rotation control means starts rotating the rotation means after a start of forced light emission of the light beam by the light amount control means.

6. The apparatus according to claim 1, wherein the light emission means includes a plurality of light sources which emit a plurality of light beams, the light amount detection means detects light amounts of said plurality of light beams emitted by said plurality of light sources, the reflection means reflects said plurality of light beams to scan said plurality of light beams emitted by said plurality of light sources, the rotation means rotates the reflection means to scan said plurality of light beams emitted by said plurality of light sources, before the rotational speed detection means detects that the rotational speed has reached the predetermined rotational speed, the light amount control means controls light emission of the light beam by one of said plurality of light sources at the ON/OFF timing of auto power control on the basis of the count of the image clock synchronized with the horizontal sync signal and controls the light amounts of the light beams emitted by said plurality of light sources to a predetermined value on the basis of the light amount detection result detected by the light amount detection means in correspondence with the light emission, and after the rotational speed detection means detects that the rotational speed has reached the predetermined rotational speed, the light emission control means controls light emission timings of said plurality of light beams by said plurality of light sources on the basis of the horizontal sync signal synchronized with the image clock.

7. The apparatus according to claim 6, wherein the light amount control means starts the forced light emission of the light beam by one of said plurality of light sources and starts light amount control of the light beam in correspondence with a timing of a start of rotation of the rotation means by the rotation control means.

8. The apparatus according to claim 6, wherein the light amount control means starts the forced light emission of the light beam by one of said plurality of light sources and starts light amount control of the light beam after an elapse of a predetermined time from a timing of a start of rotation by the rotation control means.

9. The apparatus according to claim 8, wherein the predetermined time is shorter than a difference time obtained by subtracting a time necessary after a start of light emission of the light beam until the light amount of the light beam reaches a predetermined light amount from a time necessary until the rotation means in a stopped state reaches a predetermined rotational speed.

10. The apparatus according to claim 6, wherein the rotation control means starts rotating the rotation means after a start of forced light emission of the light beam by one of said plurality of light sources by the light amount control means.

11. An image forming apparatus comprising:

light emission means for emitting a light beam;

light amount detection means for detecting a light amount of the light beam emitted by the light emission means;

reflection means for reflecting the light beam to scan the light beam emitted by the light emission means;

rotation means for rotating the reflection means to scan the light beam emitted by the light emission means;

rotation control means for controlling rotation of the rotation means;

rotational speed detection means for detecting that a rotational speed of the rotation means has reached a predetermined rotational speed;

light amount control means for, before the rotational speed detection means detects that the rotational speed has reached the predetermined rotational speed, controlling light emission of the light beam by the light emission means at the ON/OFF timing of auto power control on the basis of the count of the image clock synchronized with the horizontal sync signal and controlling the light amount of the light beam emitted by the light emission means to a predetermined value on the basis of a light amount detection result detected by the light amount detection means in correspondence with the forced light emission;

bias current control means for, before the ON timing of the auto power control, controlling ON/OFF of a bias current supplied to the light emission means at the ON/OFF timing of the bias current on the basis of the count of the image clock synchronized with the horizontal sync signal;

light emission control means for, after the rotational speed detection means detects that the rotational speed has reached the predetermined rotational speed, controlling a light emission timing of the light beam by the light emission means on the basis of the horizontal sync signal synchronized with the image clock; and image forming means for forming an image on the basis of the light beam whose light emission timing is controlled by the light emission control means and which is reflected by the reflection means.

* * * * *